US008434897B2

(12) United States Patent
Logan et al.

(10) Patent No.: US 8,434,897 B2
(45) **Date of Patent: *May 7, 2013**

(54) LED-BASED LIGHTING FIXTURES FOR SURFACE ILLUMINATION WITH IMPROVED HEAT DISSIPATION AND MANUFACTURABILITY

(75) Inventors: Derek Logan, Briarcliff Manor, NY (US); Colin Piepgras, Briarcliff Manor, NY (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

This patent is subject to a terminal disclaimer.

(21) Appl. No.: 13/108,551

(22) Filed: May 16, 2011

(65) Prior Publication Data

US 2011/0216538 A1 Sep. 8, 2011

Related U.S. Application Data

(63) Continuation of application No. 12/114,062, filed on May 2, 2008, now Pat. No. 7,878, 683.

(60) Provisional application No. 60/916,511, filed on May 7, 2007, provisional application No. 60/992,186, filed on Dec. 4, 2007, provisional application No. 60/916,496, filed on May 7, 2007, provisional application No. 60/984, 855, filed on Nov. 2, 2007.

(51) Int. Cl.
*F21S 4/00* (2006.01)
*F21V 21/00* (2006.01)

(52) U.S. Cl.
USPC ..... 362/249.02; 362/311.02; 362/800

(58) Field of Classification Search ..... 362/249.02, 362/294, 311.02, 800
See application file for complete search history.

(56) References Cited

U.S. PATENT DOCUMENTS

| | | | |
|---|---|---|---|
| 7,182,627 | B1 | 2/2007 | Huang |
| 2002/0044456 | A1 | 4/2002 | Balestriero |
| 2006/0146540 | A1 | 7/2006 | Reo et al. |
| 2007/0098334 | A1 | 5/2007 | Chen |

OTHER PUBLICATIONS

International Search Report and Written Opinion issued by the European Patent Office in a counterpart international application No. PCT/US2008/062326, Jul. 21, 2008.

*Primary Examiner* — Jason Moon Han
(74) *Attorney, Agent, or Firm* — Mark L. Beloborodov

(57) ABSTRACT

LED-based lighting apparatus and assembly methods in which mechanical and/or thermal coupling between respective components is accomplished via a transfer of force from one component to another. In one example, a multiple-LED assembly is disposed in thermal communication with a heat sink that forms part of a housing. A primary optical element situated within a pressure-transfer member is disposed above and optically aligned with each LED. A shared secondary optical facility forming another part of the housing is disposed above and compressively coupled to the pressure-transfer members. A force exerted by the second optical facility is transferred via the pressure-transfer members so as to press the LED assembly toward the heat sink, thereby facilitating heat transfer. In one aspect, the LED assembly is secured in the housing without the need for adhesives. In another aspect, the secondary optical facility does not directly exert pressure onto any primary optical element, thereby reducing optical misalignment.

15 Claims, 14 Drawing Sheets

LED-BASED LIGHTING FIXTURES FOR SURFACE ILLUMINATION WITH IMPROVED HEAT DISSIPATION AND MANUFACTURABILITY

CROSS-REFERENCES TO RELATED APPLICATIONS

The present application is a continuation of U.S. patent application Ser. No. 12/114,062, filed on May 2, 2008, which claims the benefit, under 35 U.S.C. §119(e), to the following U.S. Provisional Applications: Ser. No. 60/916,511, filed May 7, 2007, entitled "LED-based Linear Lighting Fixtures for Surface Illumination;" Ser. No. 60/992,186, filed Dec. 4, 2007, entitled "LED-based Luminaires for Surface Illumination with Improved Heat Dissipation and Manufacturability;" Ser. No. 60/916,496, filed May 7, 2007, entitled "Power Control Methods and Apparatus;" and Ser. No. 60/984,855, filed Nov. 2, 2007, entitled "LED-based Fixtures and Related Methods for Thermal Management." Each of the foregoing applications is incorporated herein by reference.

BACKGROUND

Digital lighting technologies, i.e. illumination based on semiconductor light sources, such as light-emitting diodes (LEDs), offer a viable alternative to traditional fluorescent, HID, and incandescent lamps. Functional advantages and benefits of LEDs include high energy conversion and optical efficiency, robustness, lower operating costs, and many others. LEDs are particularly suitable for applications requiring low-profile light fixtures. The LEDs' smaller size, long operating life, low energy consumption, and durability make them a great choice when space is at a premium. For example, LED-based linear fixtures can be configured as floodlight luminaires for interior or exterior applications, providing wall-washing or wall-grazing lighting effects for architectural surfaces and improving definition of three-dimensional objects.

In particular, luminaires employing high-flux LEDs are fast emerging as a superior alternative to conventional light fixtures because of their higher overall luminous efficacy and ability to generate various light patterns. However, one significant concern in the design and operation of these luminaires is thermal management, because high-flux LEDs are sensitive to heat generated during operation. Maintaining optimal junction temperature is an important component to developing an efficient lighting system, as the LEDs perform with a higher efficacy and last longer when run at cooler temperatures. The use of active cooling via fans and other mechanical air moving systems, however, is typically discouraged in the general lighting industry primarily due to its inherent noise, cost and high maintenance needs. Accordingly, heat dissipation often becomes an important design consideration.

Further, LED-based luminaires are assembled from multiple components having different thermal expansion properties and typically rely on adhesive materials for affixing these components to each other. However, conventional adhesive materials may release gases during operation of the luminaire, compromising its performance. In addition, adhered components typically cannot be taken apart and must, therefore, be discarded together even when only one of the adhered components fails or needs to be replaced. Furthermore, different thermal expansion/contraction properties of individual components often constrain the design of the luminaire. Other drawbacks of known LED-based luminaires include lack of mounting and positioning flexibility, as well as undesirable shadows between individual fixtures when connected in linear arrays.

Thus, there exists a need in the art for a high-performance LED-based lighting apparatus with improved serviceability and manufacturability, as well as light extraction and heat dissipation properties. Particularly desirable is a linear LED-based fixture suitable for wall-washing and/or wall-grazing applications that would avoid shortcomings of known approaches.

SUMMARY

Applicant herein has recognized and appreciated that at least some of the disadvantages identified above can be addressed by reducing or eliminating the use of adhesives in the luminaire assembly and mitigating the thermal expansion mismatch between its components. In view of the foregoing, various embodiments of the present invention relate generally to LED-based lighting apparatus in which at least some components of the lighting apparatus are disposed with respect to each other and configured such that mechanical and/or thermal coupling between respective components is accomplished at least in part based on the application of a force and/or transfer of pressure from one component to another.

For example, one embodiment of the present invention is directed to an LED-based lighting apparatus comprising a plurality of pressure-transfer members disposed between a secondary optical facility and an LED assembly for (i) retaining primary optical elements over corresponding LED light sources of the LED assembly and (ii) securing the LED assembly along with the primary optical elements against a heat sink of the apparatus under pressure exerted by the secondary optical facility. Such an apparatus has improved heat dissipation and light extraction properties and can be readily disassembled and reassembled for making repairs and providing maintenance.

In various implementations, lighting apparatus according to at least some embodiments disclosed herein are configured such that the physical structure of the apparatus facilitates abutting one against another, and the secondary optical facilities provide for mixing of light from adjoining apparatus, thereby creating continuous linear arrays of multiple apparatus without any gaps in light emission perceivable to an observer.

More specifically, one embodiment of the invention is directed to a lighting apparatus, comprising a heat sink having a first surface, an LED assembly disposed over the heat sink and including a plurality of LED light sources arranged on a printed circuit board, and a plurality of hollow pressure-transfer members disposed over the plurality of LED light sources. Each pressure-transfer member contains a primary optical element for collimating light generated by a corresponding LED light source. The lighting apparatus further includes an integrated secondary optical facility compressively coupled to the plurality of pressure-transfer members, such that a force exerted by the integrated secondary optical member is transferred by the pressure-transfer members so as to push the LED assembly toward the first surface of the heat sink, thereby securing it along with the primary optical elements against the heat sink of the apparatus and facilitating heat transfer from the LED assembly to the heat sink.

In one aspect of the above embodiment, the integrated secondary optical facility has a transparent upper wall defining a lens for receiving and transmitting light from the LED light source. In another aspect, the integrated secondary optical facility can be connected to the heat sink by at least one non-adhesive connector, for example, by a screw. In yet another aspect, a compliant member can be interposed between the integrated secondary optical member and the pressure-transfer members. In yet another aspect, the integrated secondary optical facility may not be compressively coupled to any of the primary optical elements.

Another embodiment of the invention is directed to a lighting apparatus, comprising a heat sink having a first surface, and an LED printed circuit board having second and third opposing surfaces, wherein the second surface is disposed on the first surface of the heat sink and wherein the third surface has at least one LED light source disposed thereon. The apparatus further comprises an integrated lens-housing member having a transparent upper wall disposed to receive light emitted by the at least one LED light source, and a pressure-transfer member having a support structure extending generally in the direction from the LED printed circuit board to the transparent upper wall of the integrated lens-housing member and further having a pressure-transfer surface connected to the support structure, wherein the support structure defines an aperture, and wherein the pressure-transfer surface is disposed on the third opposing surface of said LED printed circuit board and further disposed proximate to the LED light source. The apparatus further comprises an optic member disposed in the aperture defined by the support structure of the pressure-transfer member. The integrated lens-housing member is compressively coupled to the pressure-transfer member, such that a force exerted by the integrated lens-housing member is transferred via the pressure-transfer member to the pressure-transfer surface so as to press the LED printed circuit board toward the first surface of the heat sink, so as to provide for heat transfer from the LED printed circuit board to the heat sink.

Yet another embodiment is directed to an LED-based lighting apparatus, comprising a heat sink, an LED assembly including a plurality of LEDs disposed on a substrate, and a plurality of optical units. Each optical unit of the plurality of optical units comprises a primary optical element situated within a pressure-transfer member, wherein each optical unit is disposed above a different LED of the plurality of LEDs. The apparatus further comprises a secondary optical facility disposed above and compressively coupled to the plurality of optical units, such that a force exerted by the second optical facility is transferred via the pressure-transfer members so as to press the LED assembly toward the heat sink to facilitate heat transfer from the LED assembly to the heat sink.

Still another embodiment is directed to a method of assembling an LED-based lighting apparatus comprising a heat sink, an LED assembly including a plurality of LEDs disposed on a substrate, and a plurality of optical units. The method comprises steps of: (a) disposing the LED assembly over the heat sink; (b) retaining the plurality of optical units over the LED assembly such that each optical unit is disposed over a different LED of the plurality of LEDs; and (c) securing the LED assembly and the primary optical elements against the heat sink without employing adhesive materials. In one aspect, the step (c) comprises compressively coupling a secondary optical facility the plurality of optical units, such that a force exerted by the second optical facility secures the LED assembly against the heat sink.

Some of the advantages provided by lighting apparatus and assembly methods according to various embodiments of the present invention include improved heat dissipation and decreased operating temperatures of the LED light sources because: (i) the compressive force is applied directly to the heat generating area of the printed circuit board ("PCB") of the LED assembly, resulting in decreased thermal resistance and (ii) even distribution of retaining force from the integrated secondary optical facility generates a comparatively high compressive load in an optional thermal interface material disposed between the printed circuit board and the heat sink. Another advantage is simplified serviceability and manufacturability of the luminaire by reducing the number of process steps and component parts. Specifically, (i) the PCB (with the thermal interface material and pressure-transfer members attached) is oriented and secured in place by the integrated secondary optical facility, such that no fasteners are solely responsible for attaching the PCB; and (ii) no adhesives or fasteners are necessary to attach the pressure-transfer members to the PCB.

Relevant Terminology

As used herein for purposes of the present disclosure, the terms "LED" and "LED light source" should be understood to include any electroluminescent diode or other type of carrier injection/junction-based system that is capable of generating radiation in response to an electric signal. Thus, the term LED includes, but is not limited to, various semiconductor-based structures that emit light in response to current, light emitting polymers, organic light emitting diodes (OLEDs), electroluminescent strips, and the like. In particular, the term LED refers to light emitting diodes of all types (including semiconductor and organic light emitting diodes) that may be configured to generate radiation in one or more of the infrared spectrum, ultraviolet spectrum, and various portions of the visible spectrum (generally including radiation wavelengths from approximately 400 nanometers to approximately 700 nanometers). Some examples of LEDs include, but are not limited to, various types of infrared LEDs, ultraviolet LEDs, red LEDs, blue LEDs, green LEDs, yellow LEDs, amber LEDs, orange LEDs, and white LEDs (discussed further below). It also should be appreciated that LEDs may be configured and/or controlled to generate radiation having various bandwidths (e.g., full widths at half maximum, or FWHM) for a given spectrum (e.g., narrow bandwidth, broad bandwidth), and a variety of dominant wavelengths within a given general color categorization. For example, one implementation of an LED configured to generate essentially white light (e.g., a white LED) may include a number of dies which respectively emit different spectra of electroluminescence that, in combination, mix to form essentially white light. In another implementation, a white light LED may be associated with a phosphor material that converts electroluminescence having a first spectrum to a different second spectrum. In one example of this implementation, electroluminescence having a relatively short wavelength and narrow bandwidth spectrum "pumps" the phosphor material, which in turn radiates longer wavelength radiation having a somewhat broader spectrum.

It should also be understood that the term LED does not limit the physical and/or electrical package type of an LED. For example, as discussed above, an LED may refer to a single light emitting device having multiple dies that are configured to respectively emit different spectra of radiation (e.g., that may or may not be individually controllable). Also, an LED may be associated with a phosphor that is considered as an integral part of the LED (e.g., some types of white LEDs). In general, the term LED may refer to packaged LEDs, non-packaged LEDs, surface mount LEDs, chip-on-board LEDs, T-package mount LEDs, radial package LEDs, power package LEDs, LEDs including some type of encasement and/or optical element (e.g., a diffusing lens), etc.

The term "spectrum" should be understood to refer to any one or more frequencies (or wavelengths) of radiation produced by one or more light sources. Accordingly, the term "spectrum" refers to frequencies (or wavelengths) not only in the visible range, but also frequencies (or wavelengths) in the infrared, ultraviolet, and other areas of the overall electromagnetic spectrum. Also, a given spectrum may have a relatively narrow bandwidth (e.g., a FWHM having essentially few frequency or wavelength components) or a relatively wide bandwidth (several frequency or wavelength components having various relative strengths). It should also be appreciated that a given spectrum may be the result of a mixing of two or more other spectra (e.g., mixing radiation respectively emitted from multiple light sources).

For purposes of this disclosure, the term "color" is used interchangeably with the term "spectrum." However, the term "color" generally is used to refer primarily to a property of radiation that is perceivable by an observer (although this usage is not intended to limit the scope of this term). Accordingly, the terms "different colors" implicitly refer to multiple spectra having different wavelength components and/or bandwidths. It also should be appreciated that the term "color" may be used in connection with both white and non-white light.

The term "color temperature" generally is used herein in connection with white light, although this usage is not intended to limit the scope of this term. Color temperature essentially refers to a particular color content or shade (e.g., reddish, bluish) of white light. The color temperature of a given radiation sample conventionally is characterized according to the temperature in degrees Kelvin (K) of a black body radiator that radiates essentially the same spectrum as the radiation sample in question. Black body radiator color temperatures generally fall within a range of from approximately 700 degrees K (typically considered the first visible to the human eye) to over 10,000 degrees K; white light generally is perceived at color temperatures above 1500-2000 degrees K.

Lower color temperatures generally indicate white light having a more significant red component or a "warmer feel," while higher color temperatures generally indicate white light having a more significant blue component or a "cooler feel." By way of example, fire has a color temperature of approximately 1,800 degrees K, a conventional incandescent bulb has a color temperature of approximately 2848 degrees K, early morning daylight has a color temperature of approximately 3,000 degrees K, and overcast midday skies have a color temperature of approximately 10,000 degrees K.

The term "controller" is used herein generally to describe various apparatus relating to the operation of one or more light sources. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), and field-programmable gate arrays (FPGAs).

In various implementations, a processor or controller may be associated with one or more storage media (generically referred to herein as "memory," e.g., volatile and non-volatile computer memory such as RAM, PROM, EPROM, and EEPROM, floppy disks, compact disks, optical disks, magnetic tape, etc.). In some implementations, the storage media may be encoded with one or more programs that, when executed on one or more processors and/or controllers, perform at least some of the functions discussed herein. Various storage media may be fixed within a processor or controller or may be transportable, such that the one or more programs stored thereon can be loaded into a processor or controller so as to implement various aspects of the present disclosure discussed herein. The terms "program" or "computer program" are used herein in a generic sense to refer to any type of computer code (e.g., software or microcode) that can be employed to program one or more processors or controllers.

It should be appreciated that all combinations of the foregoing concepts and additional concepts discussed in greater detail below (provided such concepts are not mutually inconsistent) are contemplated as being part of the inventive subject matter disclosed herein: In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

Related Patents and Patent Applications

The following patents and patent applications, relevant to the present disclosure and any inventive concepts contained therein, are hereby incorporated herein by reference:

- U.S. Pat. No. 6,016,038, issued Jan. 18, 2000, entitled "Multicolored LED Lighting Method and Apparatus;"
- U.S. Pat. No. 6,211,626, issued Apr. 3, 2001, entitled "Illumination Components;"
- U.S. Pat. No. 6,975,079, issued Dec. 13, 2005, entitled "Systems and Methods for Controlling Illumination Sources;"
- U.S. Pat. No. 7,014,336, issued Mar. 21, 2006, entitled "Systems and Methods for Generating and Modulating Illumination Conditions;"
- U.S. Pat. No. 7,038,399, issued May 2, 2006, entitled "Methods and Apparatus for Providing Power to Lighting Devices;"
- U.S. Pat. No. 7,256,554, issued Aug. 14, 2007, entitled "LED Power Control Methods and Apparatus;"
- U.S. Pat. No. 7,267,461, issued Sep. 11, 2007, entitled "Directly Viewably Luminaire,"
- U.S. Patent Application Publication No. 2006-0022214, published Feb. 2, 2006 entitled "LED Package Methods and Systems;"
- U.S. Patent Application Publication No. 2007-0115665, published May 24, 2007, entitled "Methods and Apparatus for Generating and Modulating White Light. Illumination Conditions;"
- U.S. Provisional Application Ser. No. 60/916,496, filed May 7, 2007, entitled "Power Control Methods and Apparatus;"
- U.S. Provisional Application Ser. No. 60/916,511, filed May 7, 2007, entitled "LED-Based Linear Lighting Fixtures For Surface Illumination;" and
- U.S. patent application Ser. No. 11/940,926, filed on Nov. 15, 2007, entitled "LED Collimator Having Spline Surfaces And Related Methods."

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention disclosed herein.

DETAILED DESCRIPTION

Following below are more detailed descriptions of various concepts related to, and embodiments of, LED-based lighting fixtures and assembly methods according to the present invention. It should be appreciated that various aspects of inventive embodiments, as outlined above and discussed in detail below, may be implemented in any of numerous ways, as the present invention is not limited to any particular manner of implementation. Examples of specific implementations are provided for illustrative purposes only.

Various embodiments of the present invention relate generally to LED-based lighting apparatus and assembly methods in which at least some components of the lighting apparatus are disposed with respect to each other and configured such that mechanical and/or thermal coupling between respective components is accomplished at least in part based on the application and transfer of a force from one component to another. For example, in one embodiment, a printed circuit board including multiple LEDs (an "LED assembly") is disposed in thermal communication with a heat sink that forms part of a housing. A primary optical element situated within a pressure-transfer member is disposed above and optically aligned with each LED. A shared secondary optical facility (common to multiple LEDs), forming another part of the housing, is disposed above and compressively coupled to the pressure-transfer members. A force exerted by the second optical facility is transferred via the pressure-transfer members so as to press the LED assembly toward the heat sink, thereby facilitating heat transfer. In one aspect, the LED assembly is secured in the housing without the need for adhesives. In another aspect, the secondary optical facility does not directly exert pressure onto any primary optical element but instead exerts pressure to the pressure-transfer members enclosing each primary optical element, thereby reducing optical misalignment.

Figure 1A:
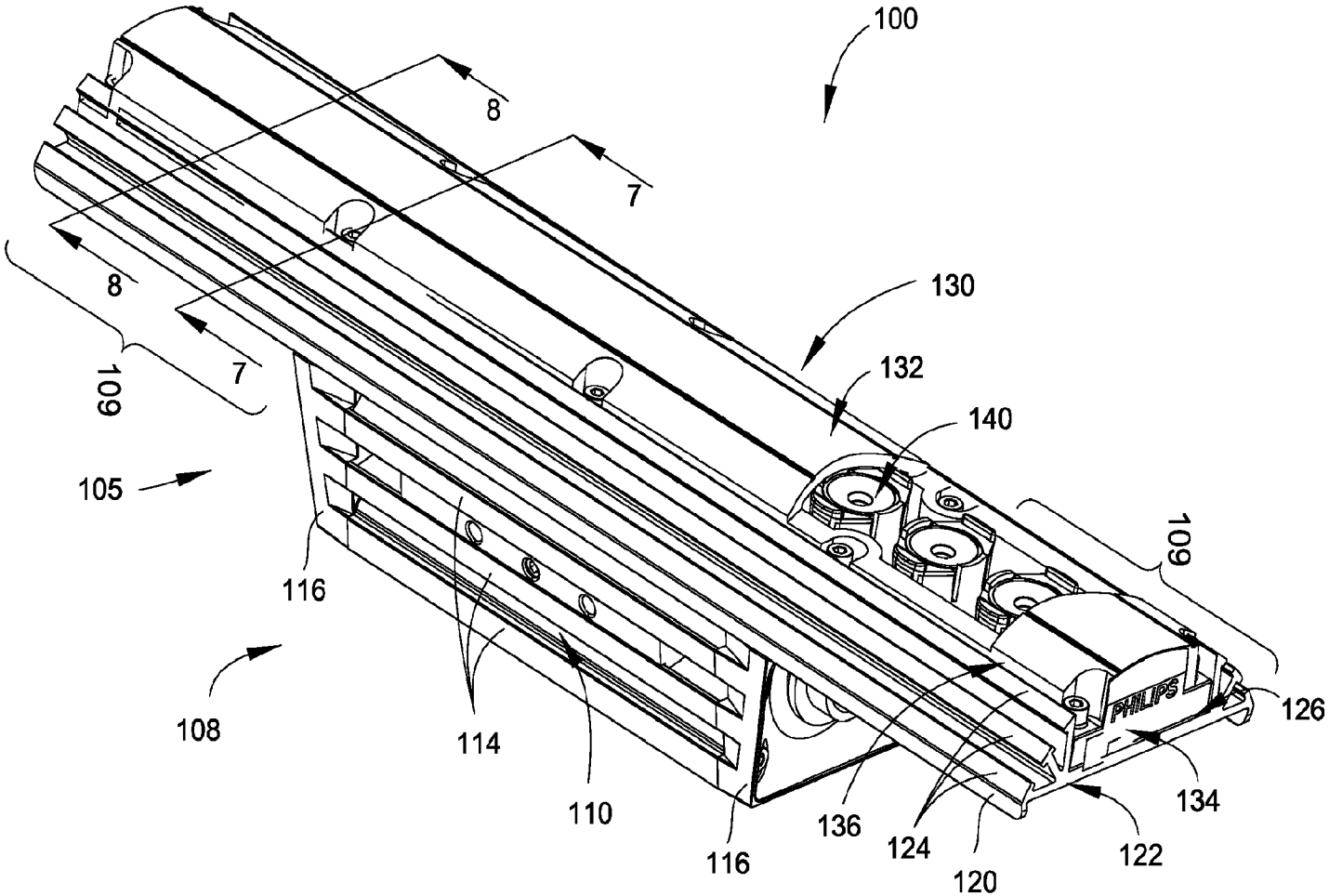
FIG. 1A is a perspective view of a lighting apparatus according to one embodiment of the present invention.

FIG. 1A illustrates a lighting apparatus 100 according to one embodiment of the present invention. The lighting apparatus includes a housing 105 comprising a top portion 120 for supporting and/or enclosing a lighting system (e.g., a light source containing one or more LEDs and associated optics, as discussed in detail below) and a bottom portion 108 that includes an electronics compartment 110. The electronics compartment houses a power supply and control circuitry for powering the lighting apparatus and controlling the light emitted by it, as described in greater detail below with reference to FIGS. 11-15.

The housing is made from a rugged, thermally conductive material, such as an extruded or die cast aluminum. Referring to FIG. 1A, in some implementations, the top portion 120 and the bottom portion 108 are a unitary, contiguous piece extruded from aluminum. In alternative implementations, the top and bottom portions are distinct component parts manufactured separately and then joined together by any method known in the art, for example, by fasteners.

Preferably, the housing is manufactured to create an offset 109 between an edge of the electronics compartment of the bottom portion 108 and an edge 122 of the top portion. The offset provides room for the interconnecting power-data cables, allowing the light-emitting portions of the lighting apparatus to be abutted against one another, thereby providing excellent light uniformity and blending at the adjoining region between adjacent lighting apparatus. Thus, continuous linear arrays of luminaires can be arranged without any gaps in light emission perceivable to an observer, as shown in FIG. 1B.

The electronics compartment 110 includes features for dissipating heat generated by the power supply and control circuitry during operation of the lighting apparatus. For example, these features include fins/protrusions 114, which extend from each of the opposing sides of the electronics compartment, as shown in FIG. 1A.

Figure 1B:
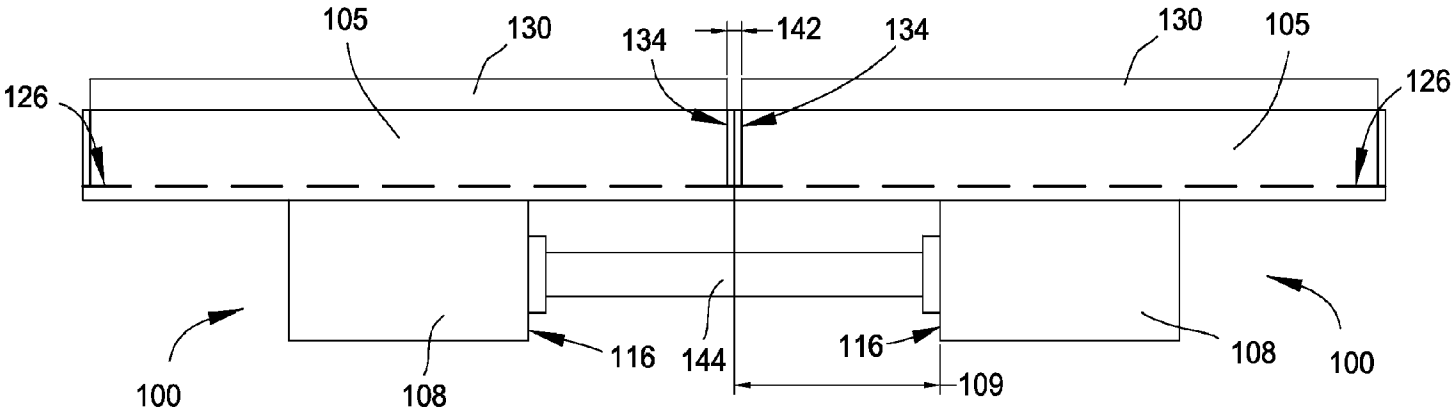
FIG. 1B is a side elevational view of two lighting apparatus of FIG. 1A forming a linear array.

As also shown in FIGS. 1A-1B, the electronics compartment further includes input and output end caps 116, which are made from die cast aluminum and are configured to connect the lighting apparatus to source power and optionally provide one or more data lines to other lighting apparatus. For example, in certain applications, a standard line voltage is delivered to a junction box, and the junction box is connected to a first lighting apparatus with a leader cable. Thus, the first lighting apparatus has an end cap configured to be connected to the leader cable. The opposing end cap of the first lighting apparatus is configured to be connected to an adjacent lighting apparatus, via a fixture-to-fixture interconnecting cable 144. In this manner, a row of lighting apparatus can be connected to form a linear lighting apparatus of predetermined length. The last end cap in a row of lighting apparatus, which is furthest from the source power and/or data line(s), is an accessory end cap, as neither power nor data need be transmitted from the final unit. The top portion 120 (also referred to as a "heat sink" throughout the specification) also has heat dissipation features for dissipating the heat generated by the lighting system during the operation of lighting apparatus 100. The heat dissipation features include fins 124, which extend from opposing sides of heat sink 120. As will be described in greater detail below with reference to FIGS. 2-8, the lighting system, including light-generating components and optical facilities, is disposed on a surface 126 of the heat sink 120.

An integrated secondary optical facility 130 is connected to the heat sink, enclosing a plurality of optical units 140 (shown in FIG. 1A by dashed lines and discussed in greater detail below). The integrated secondary optical facility includes an upper wall 132, a pair of opposing over-molded end walls 134, and a pair of opposing side walls 136. At least a portion of the upper wall 132 is transparent, defining a lens for transmitting the light generated by the light sources of the lighting system. In various implementations, the integrated secondary optical facility is a unitary structure made from a plastic, such as a polycarbonate for improved impact resistance and weatherability.

In one implementation, the over-molded end walls 134 are flat and substantially flush with edges 122 of the heat sink 120. This configuration allows another lighting apparatus 100 to be abutted against edges 122 forming a linear array with little or no gap between the abutting end walls. For example, referring to FIG. 1B, a distance 142 between a first opposing over-molded end cap of a first lighting apparatus and a second opposing over-molded end cap of a second lighting apparatus is about 0.5 millimeters. A single lighting apparatus can be, for example, one foot or four feet long, as measured between opposing edges 122. A multi-unit, linear lighting array of a predetermined length can be formed by assembling an appropriate number of the individual apparatus in the manner described above. The lighting apparatus can be mounted on, for example, a wall or ceiling by mounting devices, such as clamps, affixed to bottom portion 108, as shown in FIGS. 1C-1E.

Figure 1C:
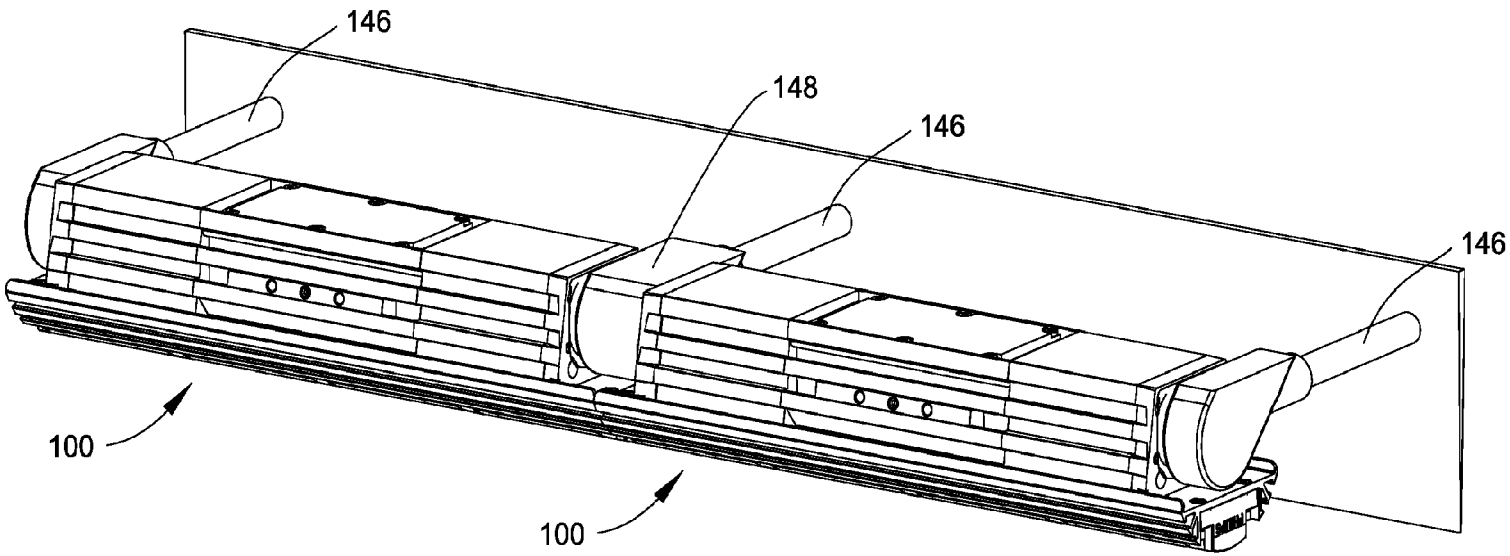
FIGS. 1C-1E depict the linear array of FIG. 1B mounted on a wall.
Figure 1D:
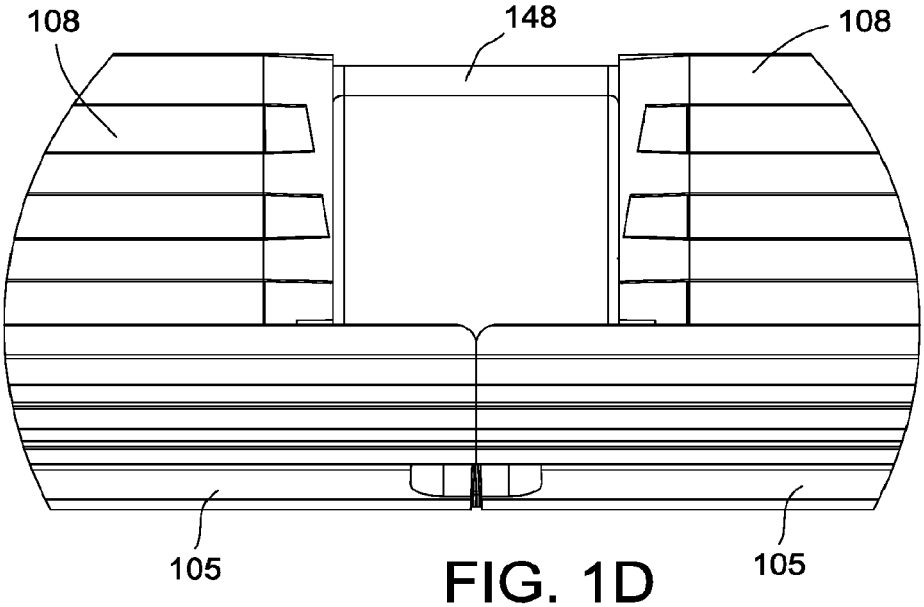
Figure 1E:
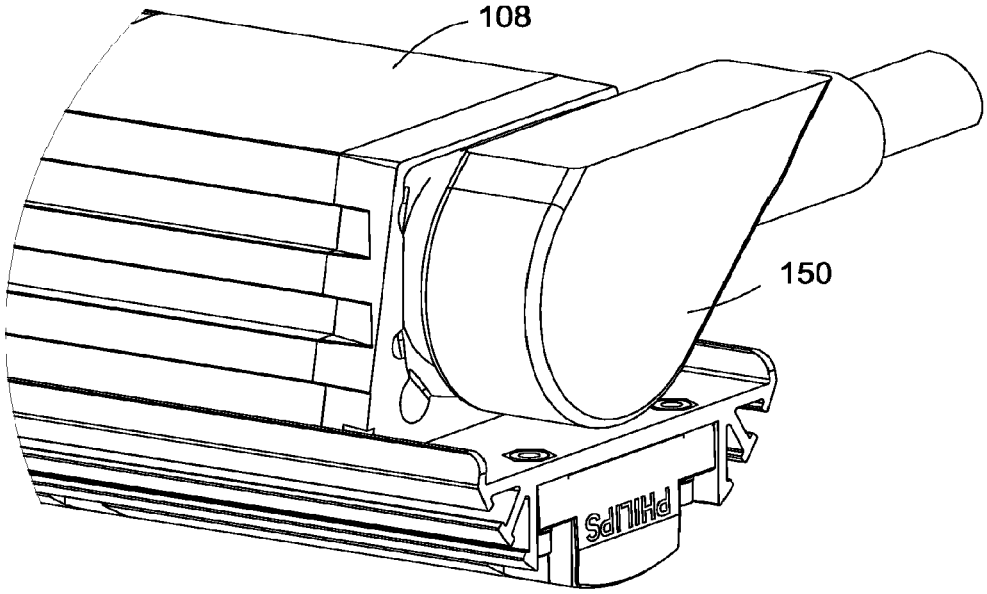

Referring to FIGS. 1C-1E, in wall-grazing applications, individual fixtures 100 and/or interconnected linear arrays of fixtures are installed proximate to the surface being illuminated, e.g. at a distance of about 4-10 inches from the surface, using cantilever mounts 146 attached to connectors 148. In some implementations, the connectors 148 can also be employed to mechanically and electrically interconnect the individual fixtures. Referring to FIG. 1D, for better aiming and positioning of the fixture relative to the architectural surface being illuminated, as well as to minimize the profile of the fixture, the connectors 148 are rotatable relative to the power supply sections 108, and, in particular, are rotatable around the electrical wiring components (e.g. the interconnecting cable 144 shown in FIG. 1B). Referring to FIG. 1E, an end-unit mounting connector 150 is rotatably connected to the last lighting apparatus in the array. Due at least in part to the minimal, if any, inter-unit gap, a linear lighting array provides excellent light uniformity over the entire length of the array with virtually no discontinuity in light emission perceivable to an observer. Furthermore, the multi-compartmental configuration of the linear lighting array mitigates the effects of the different thermal expansion coefficients of the heat sink 120 and the integrated secondary optical facility 130. That is, the expansion of the integrated secondary optical facility 130 relative to the heat sink 120 at each lighting apparatus of the array is accommodated at least in part at the junctions between the individual secondary optical facilities of the constituent lighting apparatus.

Figure 2:
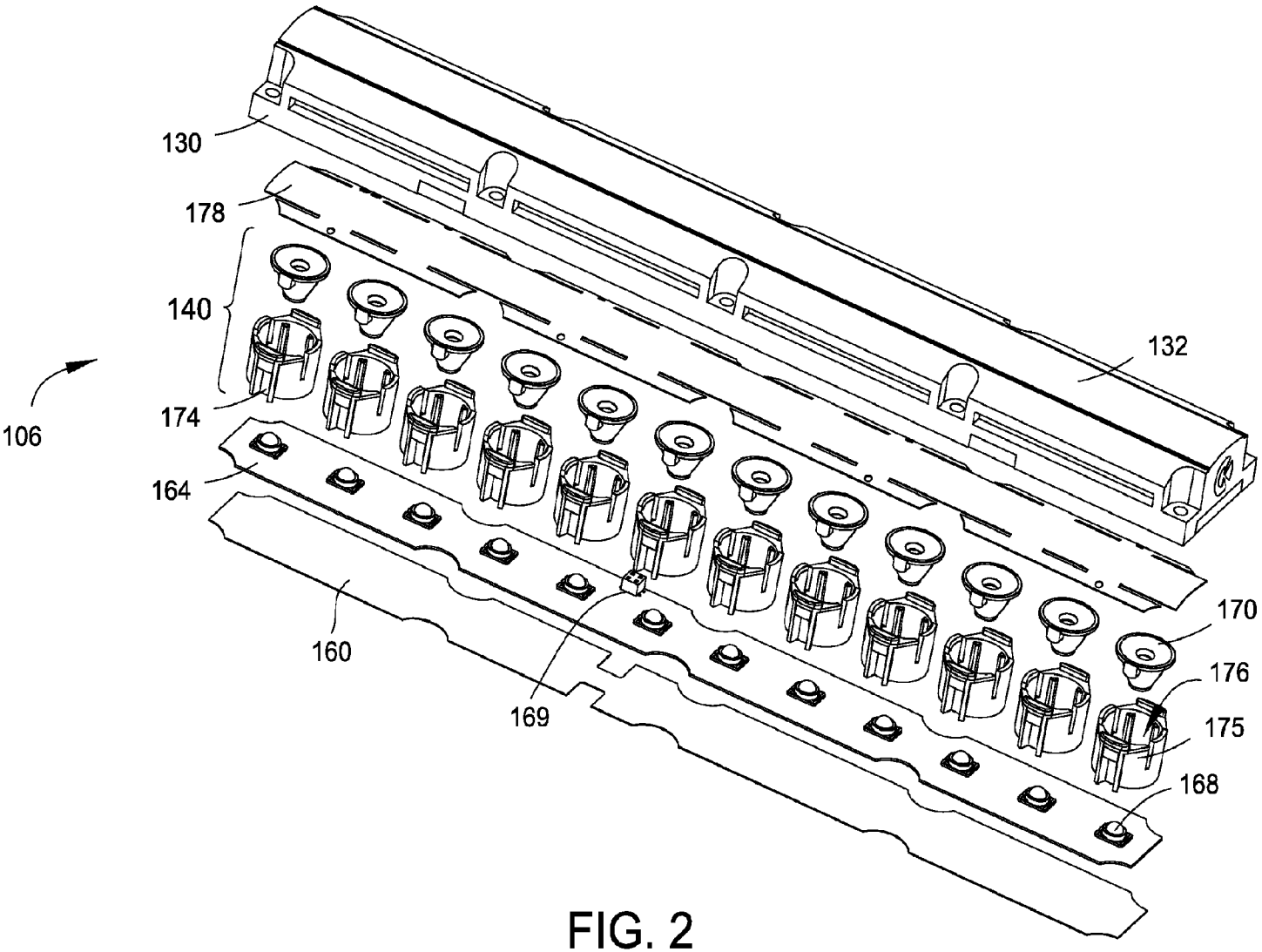
FIG. 2 is an exploded view illustrating a portion of the lighting apparatus of FIG. 1A, including an integrated secondary optical facility and a plurality of pressure-transfer members according to one embodiment of the present invention.

FIG. 2 illustrates an exploded perspective view of a lighting system 106 constituting portion of the lighting apparatus 100 shown in FIG. 1A, according to one embodiment of the present invention. The lighting system 106 is disposed on the surface 126 of the heat sink 120. In one exemplary implementation, a thermal interface layer 160 may be affixed to surface 126. While not required for assembly, in some implementations the manufacturing process optionally may be facilitated by affixing the interface layer 160 to the surface 126 by, for example, a thin film of adhesive. The thermal interface layer facilitates heat transfer to the heat sink 120. In many implementations, the thermal interface layer is a thin graphite film about 0.01 inches thick. Unlike conventional silicone gap pads, graphite material does not leech out of the interface layer over time, avoiding fogging the optical components of the lighting apparatus. Additionally, the graphite material maintains its thermal conductivity indefinitely, whereas conventional composite material gap pads degrade over time in this respect.

Still referring to FIG. 2, disposed on the thermal interface layer 160 is a printed circuit board (PCB) 164 having a plurality of LED light sources 168 arranged thereover, for example, linearly. Suitable LEDs for emitting white or colored light at high intensities can be obtained from Cree, Inc. of Durham, N.C., or Philips Lumileds of San Jose, Calif. In one implementation, the PCB 164 has a length of one foot and contains 12 XR-E 7090 LED sources 168 from Cree, each emitting white light having a color temperature of either 2700 Kelvin or 4000 Kelvin. In various implementations of the present invention, the LED PCB is not directly affixed or fastened to the interface layer and the heat sink, but rather is held in place and secured in a predetermined orientation by the compressive action of integrated secondary optical facility 130, as described in more detail below.

Electrical connections are made from the power supply and control circuitry in the electronics compartment 110 (see FIG. 1A) to LED PCB 164 via header pins (not shown) that extend from the electronics compartment 110 through a bottom-feed connector 169 in LED PCB 164, thereby powering and controlling the LED light sources 168. In some exemplary implementations, the power supply and control circuitry is based on a power supply configuration that accepts an AC line voltage and provides a DC output voltage to provide power to one or more LEDs as well as other circuitry that may be associated with the LEDs. In various aspects, suitable power supplies may be based on a switching power supply configuration and be particularly configured to provide a relatively high power factor corrected power supply. In one exemplary implementation, a single switching stage may be employed to accomplish the provision of power to a load with a high power factor. Various examples of power supply architectures and concepts that at least in part are relevant to or suitable for the present disclosure are provided, for example, in U.S. patent application Ser. No. 11/079,904, filed Mar. 14, 2005, entitled "LED Power Control Methods and Apparatus," U.S. patent application Ser. No. 11/225,377, filed Sep. 12, 2005, entitled "Power Control Methods and Apparatus for Variable Loads," and U.S. patent application Ser. No. 11/429,715, filed May 8, 2006, entitled "Power Control Methods and Apparatus," all incorporated herein by reference. Circuit diagrams for additional examples of power supply architectures particularly suitable for lighting apparatus described herein are provided in FIGS. 11-15.

Some general examples of LED-based lighting units, including the configuration of LED light sources with power and control components, may be found, for example, in U.S. Pat. No. 6,016,038, issued Jan. 18, 2000 to Mueller et al., entitled "Multicolored LED Lighting Method and Apparatus," and U.S. Pat. No. 6,211,626, issued Apr. 3, 2001 to Lys et al, entitled "Illumination Components," which patents are both hereby incorporated herein by reference. Also, some general examples of digital power processing and integrating power and data management within an LED fixture, suitable for use in conjunction with luminaires of the present disclosure, can be found, for example, in U.S. Pat. No. 7,256,554, and U.S. Provisional Patent Application Ser. No. 60/916,496;

all incorporated herein by reference as indicated in the "Related Patents and Patent Applications" section above.

Figure 3:
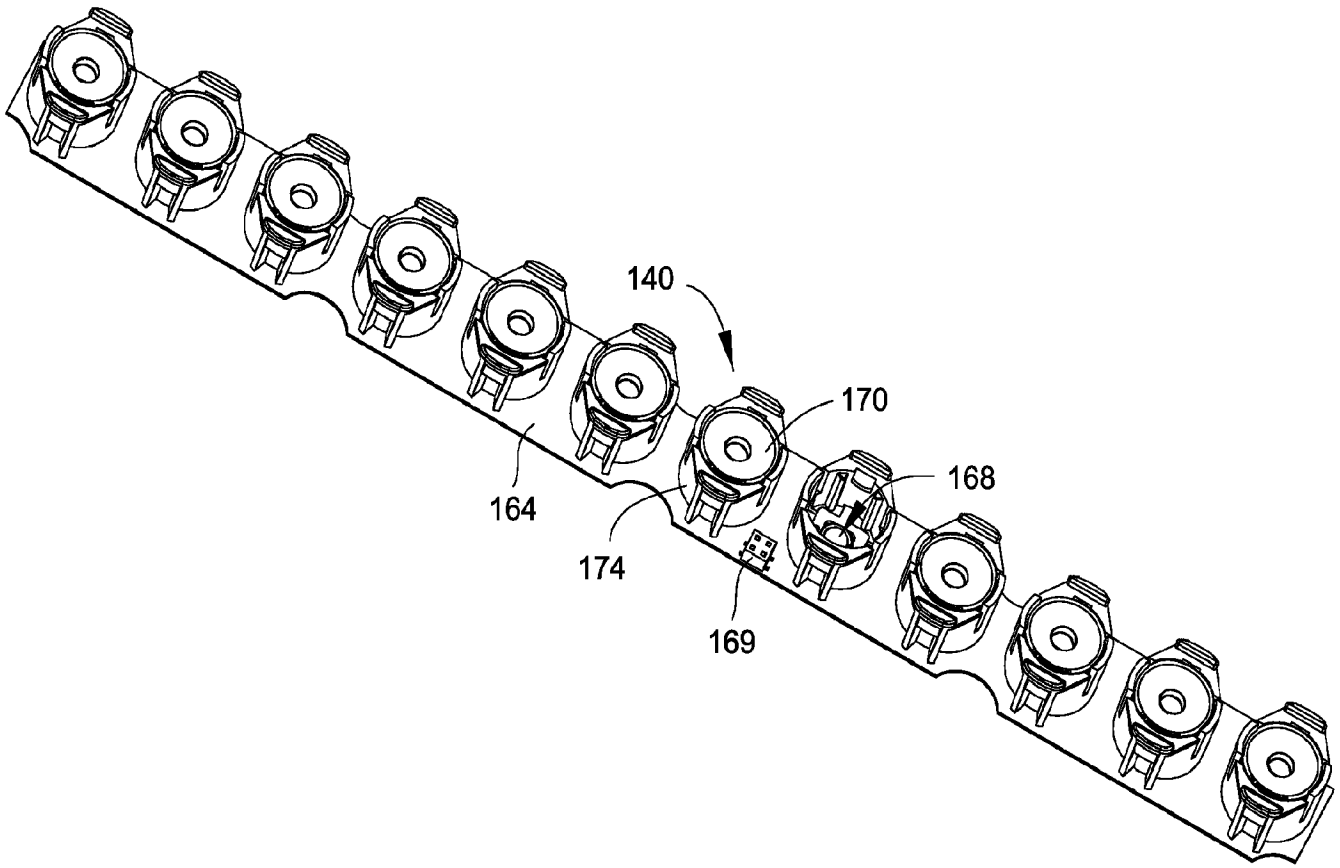
FIG. 3 is a top perspective view illustrating optical units disposed over an LED PCB according to one embodiment of the present invention.

Referring to FIG. 3, and with continued reference to FIG. 2, the lighting system 106 further includes a plurality of optical units 140, arranged along the LED PCB 164, for example, linearly. The optical units will be described in greater detail below with reference to FIGS. 4-8. In general, one optical unit is centered over each LED light source 168 and is oriented to transmit the light toward a transparent portion or lens of the upper wall 132 of integrated secondary optical facility 130. Each optical unit includes a primary optical element 170 and a pressure-transfer member 174, serving as a holder for the primary optical element. The pressure-transfer member includes a support structure/wall 175, defining an aperture 176, and is made from an opaque, rugged material, such as a molded plastic. In many implementations, the primary optical element is a total internal reflection ("TIR") collimator, configured for controlling the directionality of, or collimating, the light emitted by a corresponding LED light source 168. Some examples of collimators suitable as primary optical elements described herein are disclosed in co-pending U.S. patent application Ser. No. 11/940,926, incorporated herein by reference.

In some exemplary implementations, the present invention contemplates utilizing a holographic diffusing film in order to increase mixing distance and improve illumination uniformity while maintaining high efficiency. For example, referring to FIG. 2, a light diffusion layer 178 is disposed proximate to an interior surface of the upper wall 132 of the integrated secondary optical facility 130. The light diffusion layer can be a polycarbonate film, about 0.01 inches thick (or other suitable film or "light shaping diffusers," available from Luminit LLC, http://www.luminitco.com), and can further be textured on the side proximate to the upper wall. Another approach suitable for improving illumination uniformity via an auxiliary diffusing layer is disclosed in U.S. Pat. No. 7,267,461, issued Sep. 11, 2007, entitled "Directly Viewably Luminaire," hereby incorporated herein by reference.

Figure 4:
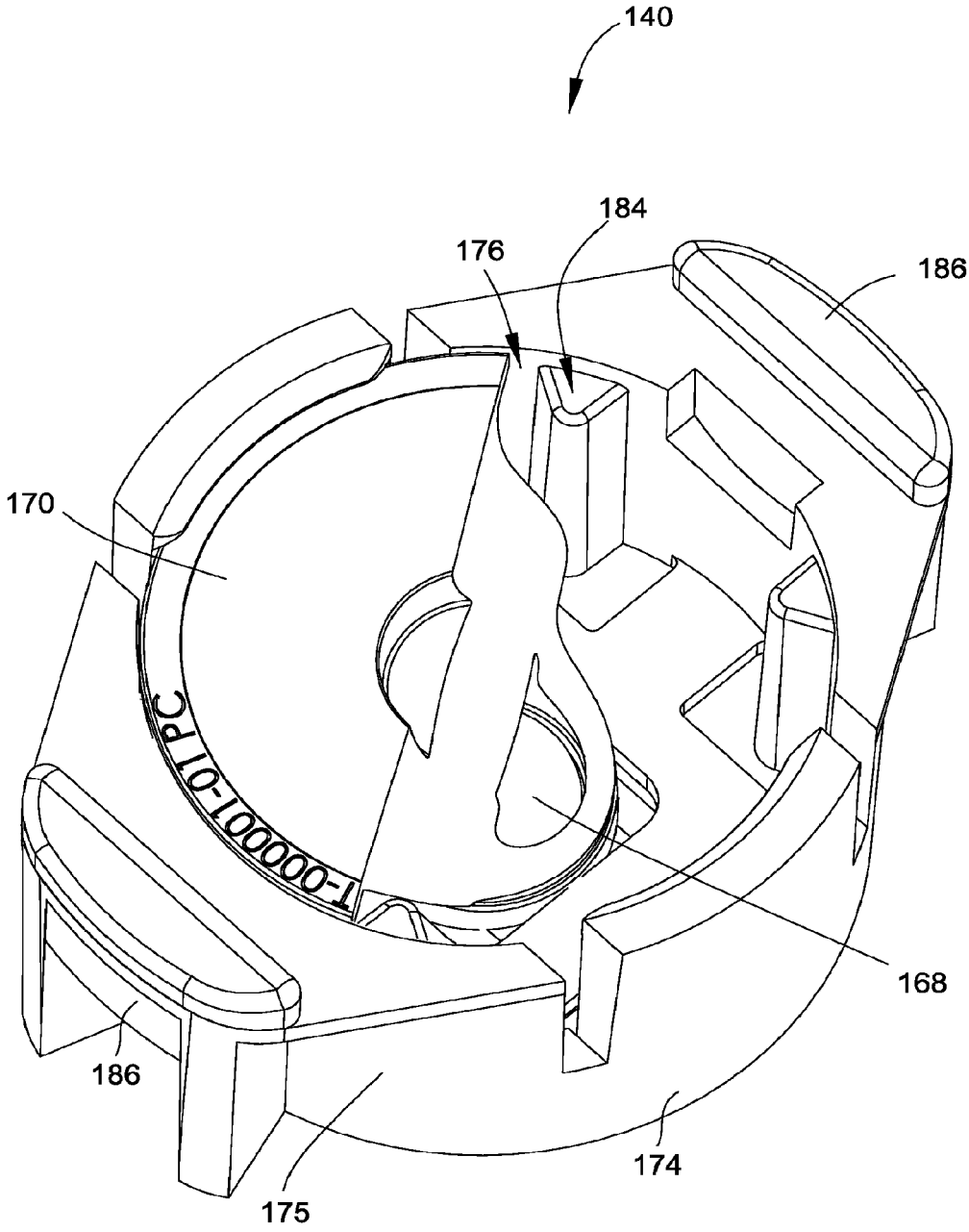
FIGS. 4-6 illustrate perspective, top plan, and bottom plan views of the optical units of FIG. 3, according to one embodiment of the present invention.
Figure 5:
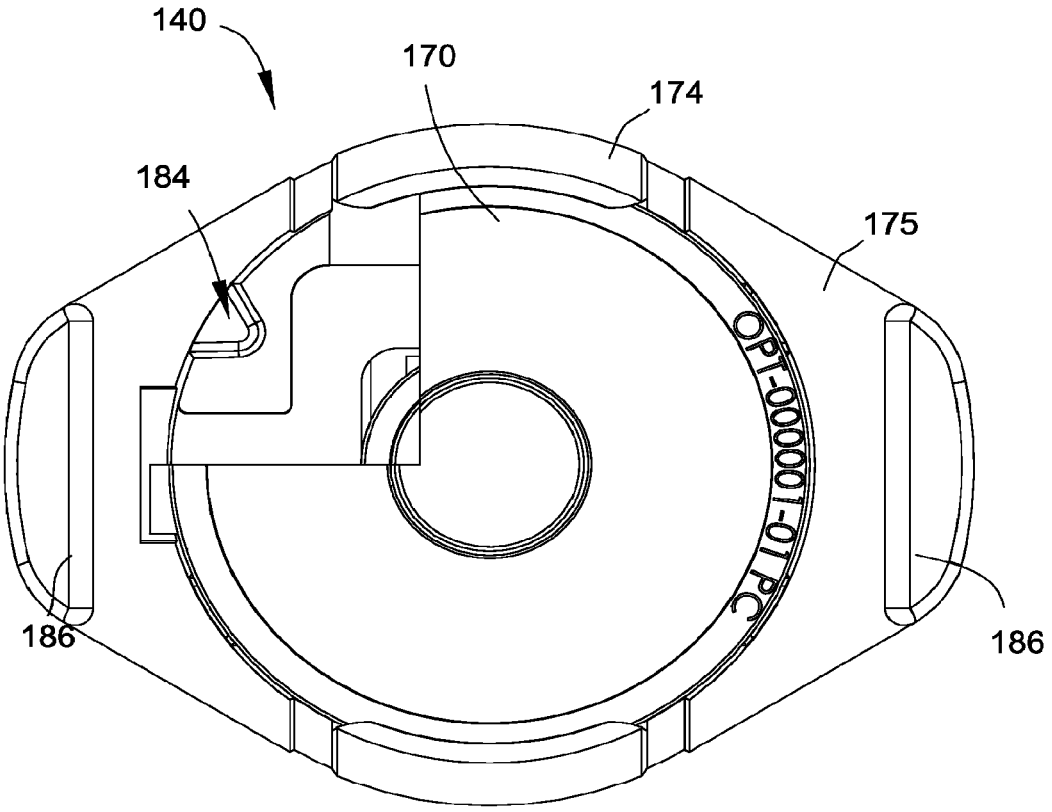
Figure 6:
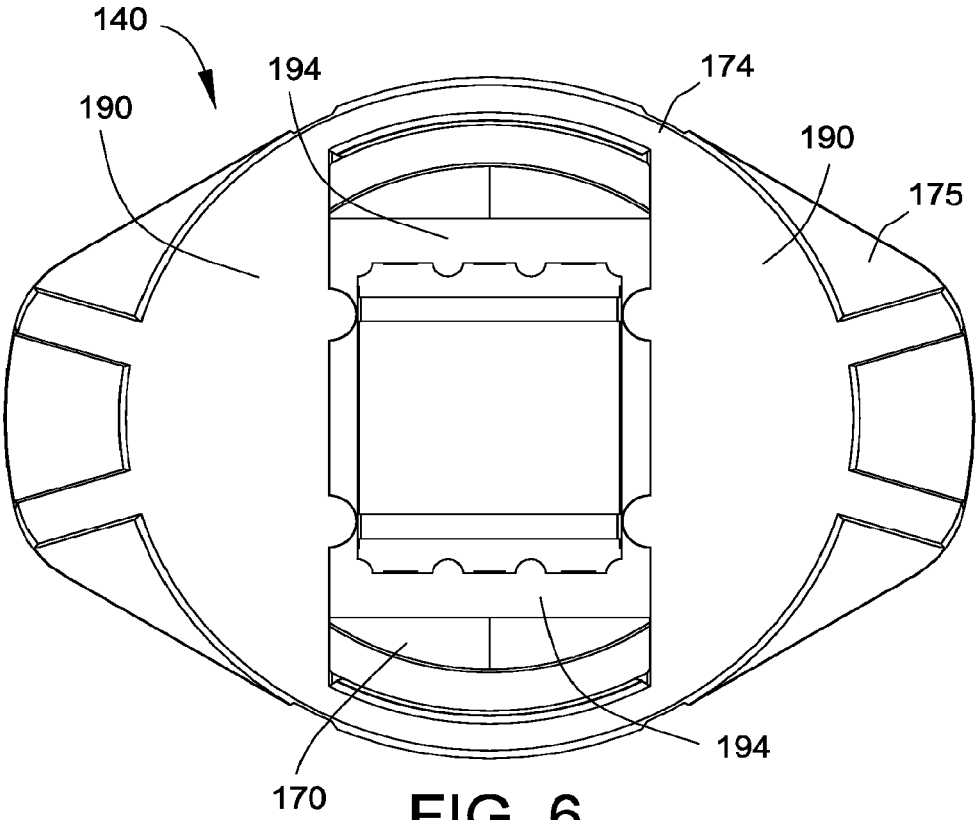

Referring now to FIGS. 4-6, the pressure-transfer member 174 of the optical unit 140 has a support structure or wall 175 that extends generally in the direction from LED PCB 164 toward the upper wall 132 of the integrated secondary optical facility 130. The primary optical element 170 is seated in the aperture 176 of the pressure-transfer member 174 and is retained by, for example, a snap fit. The pressure-transfer member further includes (i) a plurality of interior ribs 184 for supporting the primary optical element 170 within the aperture 176, and (ii) a pair of compliant members 186 disposed on a top rim of the pressure-transfer member. The compliant members are made from a compliant material selected for its compression recovery and resistance to compression set. This allows consistent forces to be applied to the support structure 175 over extended periods of thermal cycling (i.e., turning on and off the lighting apparatus). In various implementations, the compliant member is a thermoplastic elastomer, and is manufactured by injecting the compliant material in a molten state into a small aperture in the support structure 175.

As described in greater detail with reference to FIG. 8, the compliant member is useful for addressing tolerance stack-up issues at the juncture of the optical unit 140 and the integrated secondary optical facility 130, which is compressively coupled to the pressure-transfer member 174. That is, due to the dimensional tolerances during manufacturing of each of the components that are stacked on the surface 126, the configuration of each optical unit relative to integrated secondary optical facility 130 may vary slightly across the LED PCB. The compliant member is designed to correct for these differences and to result in the application of about the same amount of force at the LED PCB over a possible range of compressions exerted by the integrated secondary optical facility. Thus, a lighting apparatus in accordance with the present invention has improved structural integrity and provides greater consistency and improved predictability of operating conditions. In some implementations, the compliant member is not attached to the pressure-transfer member, but rather is configured to make contact with the pressure-transfer member to achieve the functions described above.

With reference to FIG. 6, the pressure-transfer member 174 further includes a pressure-transfer surface 190 and opposing alignment ribs 194, which are located at the end opposite compliant members 186. The pressure-transfer surface 190 is contiguous with the support structure 175 and generally perpendicular to it. The pressure-transfer surface is configured to rest on LED PCB 164, proximate to the LED light source 168. In some embodiments, the opposing alignment ribs are a part of the pressure-transfer surface, the opposing alignment ribs being generally coplanar with the pressure-transfer surface and functioning to exert pressure in a manner similar to that of pressure-transfer surface 190; in other embodiments, the opposing alignment ribs are not coplanar with pressure-transfer surface 190 and do not exert pressure onto the LED PCB. In the latter embodiments, the opposing alignment ribs are configured to engage the primary optical element 170 and appropriately orient the primary optical element with respect to the LED light source. The pressure-transfer surface 190 is configured to engage the LED light source and appropriately orient the pressure-transfer member 174 with respect to the LED light source. The integrated secondary optical facility contacts the pressure-transfer member at compliant members 186.

Figure 7:
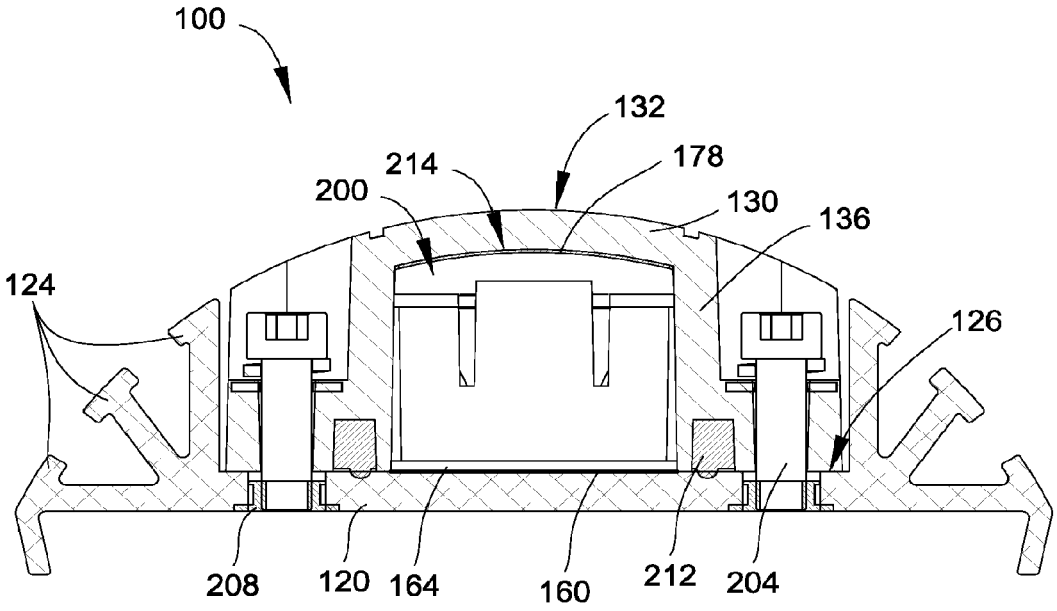
FIG. 7 is a cross-sectional view of the lighting apparatus of FIG. 1A taken along a cutting plane line 7-7 in FIG. 1A.

Referring now to FIG. 7, a cross-sectional view is illustrated of the lighting apparatus 100, taken along a cutting plane line 7-7 in FIG. 1A. The cross-section is taken at a region between adjacent optical units 140. The integrated secondary optical facility 130 defines an aperture 200 in which the optical units are disposed, and further defines opposing side walls 136. The opposing side walls are contiguous with the upper wall 132. The over-molded end walls 134 (see FIG. 1A) are contiguous with the opposing side walls. Thus, the integrated secondary optical facility can be made by extruding one piece of plastic material. In some embodiments of the invention, the integrated secondary optical facility is only transparent at the transparent upper wall, the opposing side walls and end walls being opaque. In many embodiments of the invention, the integrated secondary optical facility is connected to the heat sink by non-adhesive connectors, such as screws, clips, and/or other mechanical fasteners. For example, the integrated secondary optical facility can be connected to the heat sink 120 by pairs of screws 204 and nuts 208 positioned along the length of the integrated secondary optical facility, as shown in FIG. 7. Thus, a lighting apparatus disclosed herein does not require adhesive layers, the thickness of which can be difficult to control, resulting in unpredictable heat transfer characteristics. The lighting apparatus in accordance with the invention is also easily disassembled, to allow access to individual components for repair or replacement, thereby reducing waste and realizing a more environmentally-friendly fixture.

Still referring to FIG. 7, the lighting apparatus further includes a molded gasket 212, which is placed in a shallow groove along the perimeter of the integrated secondary optical facility. The groove runs through each of the side walls and end walls, in the surface that abuts against the surface 126 of the heat sink. When screws 204 are tightened, the integrated secondary optical facility exerts a downward force, in the direction of LED PCB 164. The lens includes features that when assembled bottom out to a proper gasket compression, thereby compressing the gasket against the heat sink to provide a seal and preventing over-compression. In various embodiments, the integrated secondary optical facility has a minimum thickness selected for optimal fire resistance. In some embodiments, the minimum thickness, t, is about 3 millimeters. As further illustrated in FIG. 7, light diffusion layer 178 is disposed on an inner surface 214 of the upper wall of the integrated secondary optical facility.

Figure 8:
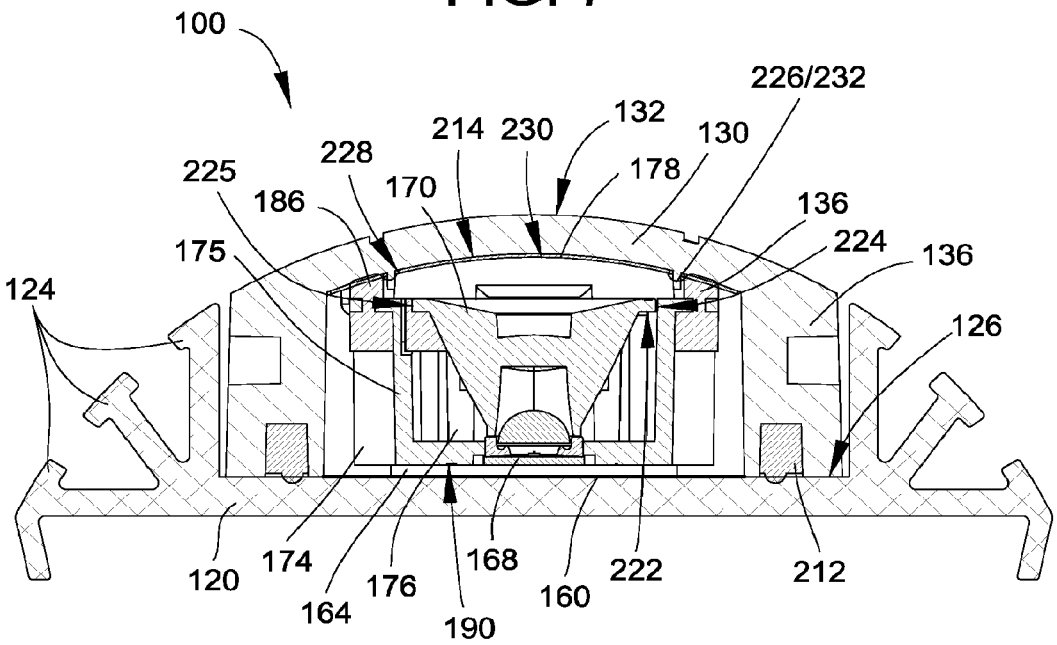
FIG. 8 is a cross-sectional view of the lighting apparatus taken along a cutting plane line 8-8 in FIG. 1A.

Referring now to FIG. 8, a cross-sectional view is illustrated of lighting apparatus 100, taken along a cutting plane line 8-8 in FIG. 1A, which passes through pressure-transfer member 174 and primary optical element 170. In general, opposing side walls 136 are connected to the heat sink so as to generate a force exerted by the integrated secondary optical facility 130 onto the pressure-transfer member 174. As shown in FIG. 8 and with continued reference to FIG. 7, the LED PCB 164 and thermal interface layer 160 are retained against the heat sink 120 by the force exerted by the integrated secondary optical facility via the action of screws 204 and nuts 208, which force is transmitted through compliant members 186 and pressure-transfer member 174. That is, the integrated secondary optical facility is compressively coupled to the pressure-transfer member, such that force exerted by the integrated secondary optical facility is transferred via the pressure-transfer member to pressure-transfer surface 190 so as to press the LED PCB and the interface layer toward surface 126 of the heat sink. This configuration provides for improved heat transfer from the LED PCB to the heat sink during the operation of the lighting apparatus, thereby extending the operating lifetime and improving efficiency of the lighting apparatus.

As further illustrated in FIG. 8, the integrated secondary optical facility 130 can be configured such that it presses down on the compliant members 186, which can be compressed as well as transfer the load to pressure-transfer member 174 (also serving as an optic holder). Thus, dimensional differences among similar components are absorbed at the compliant members. However, in many embodiments, the integrated secondary optical facility is not compressively coupled to primary optical element 170. That is, the integrated secondary optical facility does not press down onto the optical element. This configuration, in conjunction with the compliance of the compliant members, mitigates the amount of tilting or displacement of the optical elements, thereby improving the control and consistency of the directionality of the light emitted by the lighting apparatus during its operation.

In various embodiments, and as further illustrated in FIG. 8, the primary optical element 170 is suspended within the aperture 176 defined by the pressure-transfer member 174, by resting on a ledge/support surface 222 of support structure 175 of the pressure-transfer member. The optical element can be retained by the support structure by a snap fit (not shown). Further illustrated in FIG. 8 is a sidewall 224 defined by the support structure, which opposes an outer, vertical surface 225 along the circumference of the primary optical element 170. Because the pressure-transfer member is opaque, this configuration blocks light that escapes through surface 225 during the operation of the lighting apparatus.

In some embodiments, and as illustrated in FIG. 8, the inner surface 214 of the upper wall 132 further includes a plurality of connecting pins 226, which can be contiguous with the upper wall 132. During the assembly of the integrated secondary optical facility 130 with light diffusion layer 178, the connecting pins are initially configured to be inserted into holes 228 in the light diffusion layer. Initially, the connecting pins are shaped to be inserted through the holes in the light diffusion layer. Thus, initially they are straight and long enough to extend somewhat beyond an inner surface 230 of the light diffusion layer. For example, the connecting pins can extend by about 2 millimeters beyond inner surface 230. Then, extending ends of the connecting pins are permanently deformed, such as by heating with an acoustic horn or vibration, thereby creating a retaining head 232 in the connecting pin. Retaining heads 232 and compliant members 186 together retain the light diffusion layer against the integrated secondary optical facility.

In many implementations and embodiments, and as further illustrated in FIG. 8, pressure-transfer surface 190 of pressure-transfer member 174 extends up to the LED light source 168, so as to define a shortest distance d between the pressure-transfer surface and the LED light source, which is less than about 2 millimeters. In some embodiments, the shortest distance is about 1 millimeter. By being proximate to the LED light source, the pressure-transfer surface ensures that no gaps exist or are generated between LED PCB 164, thermal interface layer 160, and surface 126 during the operation of the lighting apparatus, as the components are heated and tend to expand/contract. In this manner, excellent heat transfer from the LED light source to heat sink 120 is provided, which heat is ultimately dissipated at fins 124.

Figure 9:
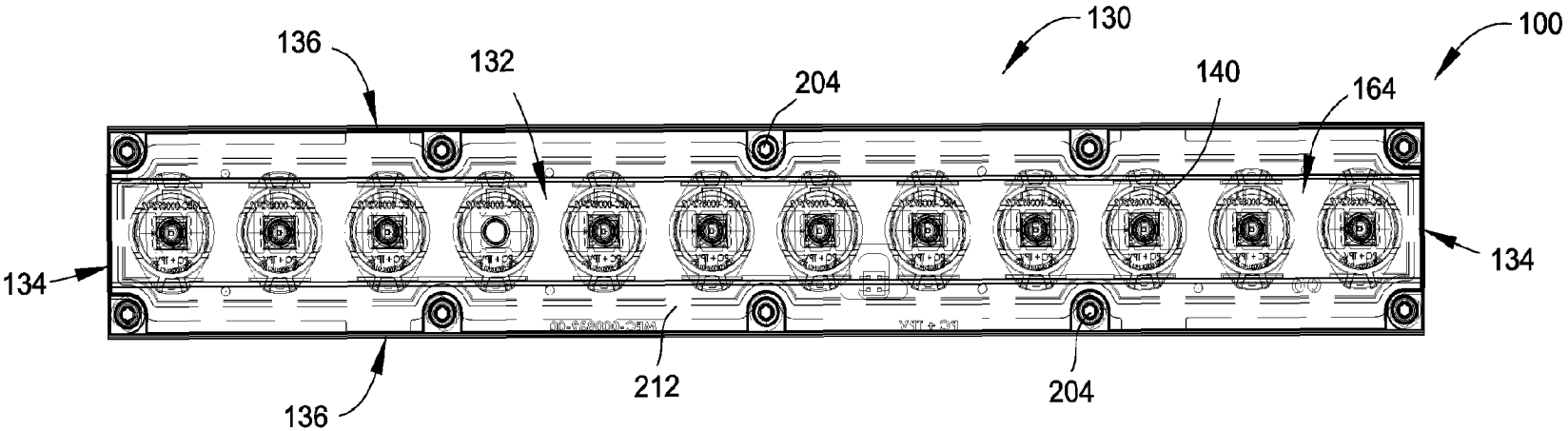
FIG. 9 is a partial top plan view of a lighting apparatus according to one embodiment of the present invention.

Referring now to FIG. 9, and as mentioned above, the integrated secondary optical facility 130 is disposed over the optical units 140, securing the LED PCB 164 against the heat sink 120 in a predetermined orientation. As further illustrated in FIG. 9, in various implementations, the gasket 212 is disposed between LED PCB 164 and screws 204, to seal the lighting system from the ambient. In some implementations, an inner surface of the walls 136 are configured to receive and snugly accommodate the pressure-transfer members.

Figure 10:
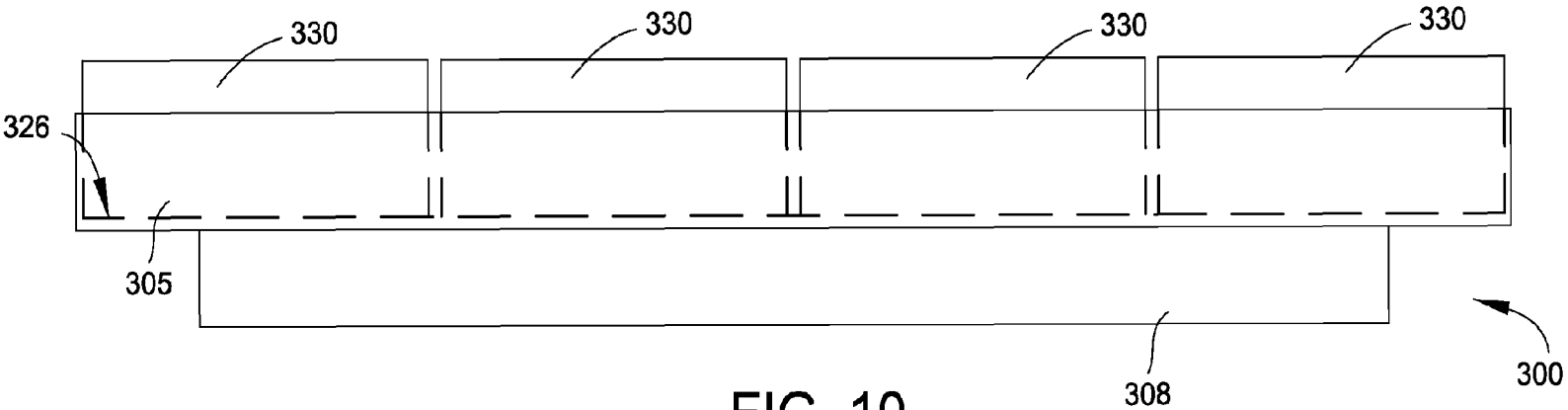
FIG. 10 is a side elevational view of a linear lighting apparatus having multiple integrated secondary optical facilities according to one embodiment of the present invention.

Referring now to FIG. 10, in some implementations of the disclosure, a linear lighting apparatus 300 has a bottom portion 308 that underlies multiple integrated secondary optical facilities 330, which are disposed on a surface 326 of a top portion 305. That is, the extruded aluminum portion of the apparatus is one contiguous piece, while each of integrated secondary optical facilities is a separate structure overlying corresponding LED PCB.

As mentioned above, the power supply/control circuitry which is housed in electronics compartment 110 is based on a power supply configuration that accepts an AC line voltage and provides a DC output voltage to power one or more LEDs as well as other circuitry that may be associated with the LEDs. Various implementations of lighting apparatus according to the present invention are capable of producing light output of 450-550 lumens/foot, while consuming 15 W/foot of power. Thus, if the apparatus includes four one-foot LED PCB's 164, the total light output may range from 1800 to 2200 lumens.

With respect to the power supply/control circuitry, in various embodiments, power may be supplied to the LED light sources 168 without requiring any feedback information associated with the light sources. For purposes of the present disclosure, the phrase "feedback information associated with a load" refers to information relating to the load (e.g., a load voltage and/or load current of the LED light sources) obtained during normal operation of the load (i.e., while the load performs its intended functionality), which information is fed back to the power supply providing power to the load so as to facilitate stable operation of the power supply (e.g., the provision of a regulated output voltage). Thus, the phrase "without requiring any feedback information associated with the load" refers to implementations in which the power supply providing power to the load does not require any feedback information to maintain normal operation of itself and the load (i.e., when the load is performing its intended functionality).

Figure 11:
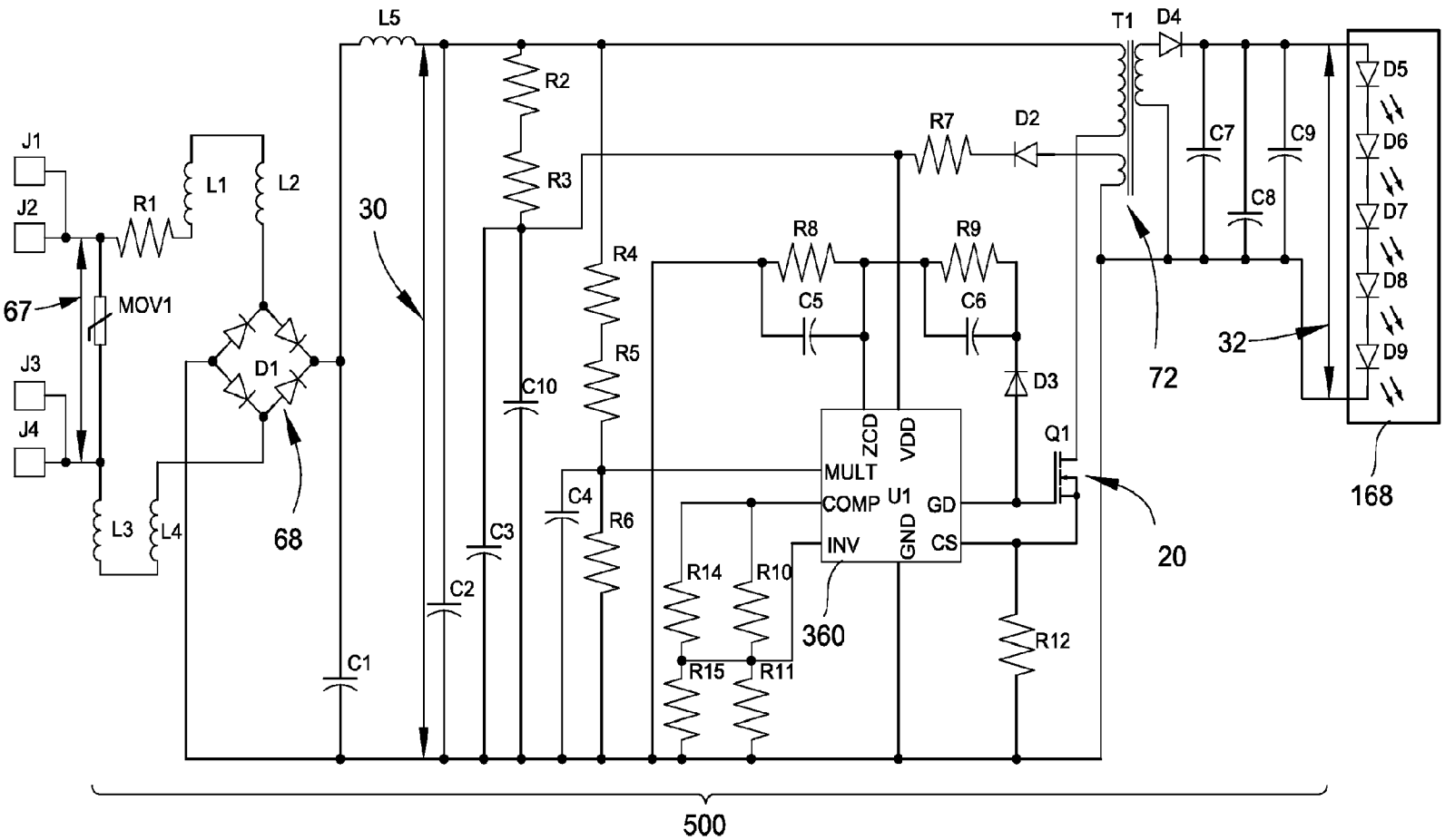
FIGS. 11-15 are schematic circuit diagrams of power supplies for providing power to lighting apparatus according to various embodiments of the present invention.

FIG. 11 is a schematic circuit diagram illustrating an example of a high power factor, single switching stage, power supply 500 according to one embodiment of the present invention, wherein the power supply may be housed in the electronics compartment 110 and provide power to the LED light sources 168. The power supply 500 is based on the flyback converter arrangement employing a switch controller 360 implemented by an ST6561 or ST6562 switch controller available from ST Microelectronics. An A.C. input voltage 67 is applied to the power supply 500 at the terminals J1 and J2 (or J3 and J4) shown on the far left of the schematic, and a D.C. output voltage 32 (or supply voltage) is applied across a load which includes five LED light sources 168. In one aspect, the output voltage 32 is not variable independently of the A.C. input voltage 67 applied to the power supply 500; stated differently, for a given A.C. input voltage 67, the output voltage 32 applied across the load 168 remains essentially substantially stable and fixed. It should be appreciated that the particular load is provided primarily for purposes of illustration, and that the present disclosure is not limited in this respect; for example, in other embodiments of the invention, the load may include a same or different number of LEDs interconnected in any of a variety of series, parallel, or series/parallel arrangements. Also, as indicated in Table 1 below, the power supply 500 may be configured for a variety of different input voltages, based on an appropriate selection of various circuit components (resistor values in Ohms).

TABLE 1

| A.C. Input Voltage | R2 | R3 | R4 | R5 | R6 | R8 | R10 | R11 | Q1 |
|---|---|---|---|---|---|---|---|---|---|
| 120 V | 150K | 150K | 750K | 750K | 10.0K 1% | 7.5K | 3.90K 1% | 20.0K 1% | 2SK3050 |
| 230 V | 300K | 300K | 1.5M | 1.5M | 4.99K 1% | 11K | 4.30K 1% | 20.0K 1% | STD1NK80Z |
| 100 V | 150K | 150K | 750K | 750K | 10.0K 1% | 7.5K | 2.49K 1% | 10.0K 1% | 2SK3050 |
| 120 V | 150K | 150K | 750K | 750K | 10.0K 1% | 7.5K | 3.90K 1% | 20.0K 1% | 2SK3050 |
| 230 V | 300K | 300K | 1.5M | 1.5M | 4.99K 1% | 11K | 4.30K 1% | 20.0K 1% | STD1NK80Z |
| 100 V | 150K | 150K | 750K | 750K | 10.0K 1% | 7.5K | 2.49K 1% | 10.0K 1% | 2SK3050 |

In one aspect of the embodiment shown in FIG. 11, the controller 360 is configured to employ a fixed-off time (FOT) control technique to control a switch 20 (Q1). The FOT control technique allows the use of a relatively smaller transformer 72 for the flyback configuration. This allows the transformer to be operated at a more constant frequency, which in turn delivers higher power to the load for a given core size.

In another aspect, unlike conventional switching power supply configurations employing either the L6561 or L6562 switch controllers, the switching power supply 500 of FIG. 11 does not require any feedback information associated with the load to facilitate control of the switch 20 (Q1). In conventional implementations involving the STL6561 or STL6562 switch controllers, the INV input (pin 1) of these controllers (the inverting input of the controller's internal error amplifier) typically is coupled to a signal representing the positive potential of the output voltage (e.g., via an external resistor divider network and/or an optoisolator circuit), so as to provide feedback associated with the load to the switch controller. The controller's internal error amplifier compares a portion of the fed back output voltage with an internal reference so as to maintain an essentially constant (i.e., regulated) output voltage.

In contrast to these conventional arrangements, in the circuit of FIG. 11, the INV input of the switch controller 360 is coupled to ground potential via the resistor R11, and is not in any way deriving feedback from the load (e.g., there is no electrical connection between the controller 360 and the positive potential of the output voltage 32 when it is applied to the LED light sources 168). More generally, in various inventive embodiments disclosed herein, the switch 20 (Q1) may be controlled without monitoring either the output voltage 32 across the load or a current drawn by the load when the load is electrically connected to the output voltage 32. Similarly, the switch Q1 may be controlled without regulating either the output voltage 32 across the load or a current drawn by the load. Again, this can be readily observed in the schematic of FIG. 11, in that the positive potential of the output voltage 32 (applied to the anode of LED D5 of the load 100) is not electrically connected or "fed back" to any component on the primary side of transformer 72.

By eliminating the requirement for feedback, various lighting apparatus according to the present invention employing a switching power supply may be implemented with fewer components at a reduced size/cost. Also, due to the high power factor correction provided by the circuit arrangement shown in FIG. 11, the lighting apparatus appears as an essentially resistive element to the applied input voltage 67.

In some exemplary implementations, a lighting apparatus including the power supply 500 may be coupled to an A.C. dimmer, wherein an A.C. voltage applied to the power supply is derived from the output of the A.C. dimmer (which in turn receives as an input the A.C. line voltage 67). In various aspects, the voltage provided by the A.C. dimmer may be a voltage amplitude controlled or duty-cycle (phase) controlled A.C. voltage, for example. In one exemplary implementation, by varying an RMS value of the A.C. voltage applied to the power supply 500 via the A.C. dimmer, the output voltage 32 to the load may be similarly varied. In this manner, the A.C. dimmer may thusly be employed to vary a brightness of light generated by the LED light sources 168.

Figure 12:
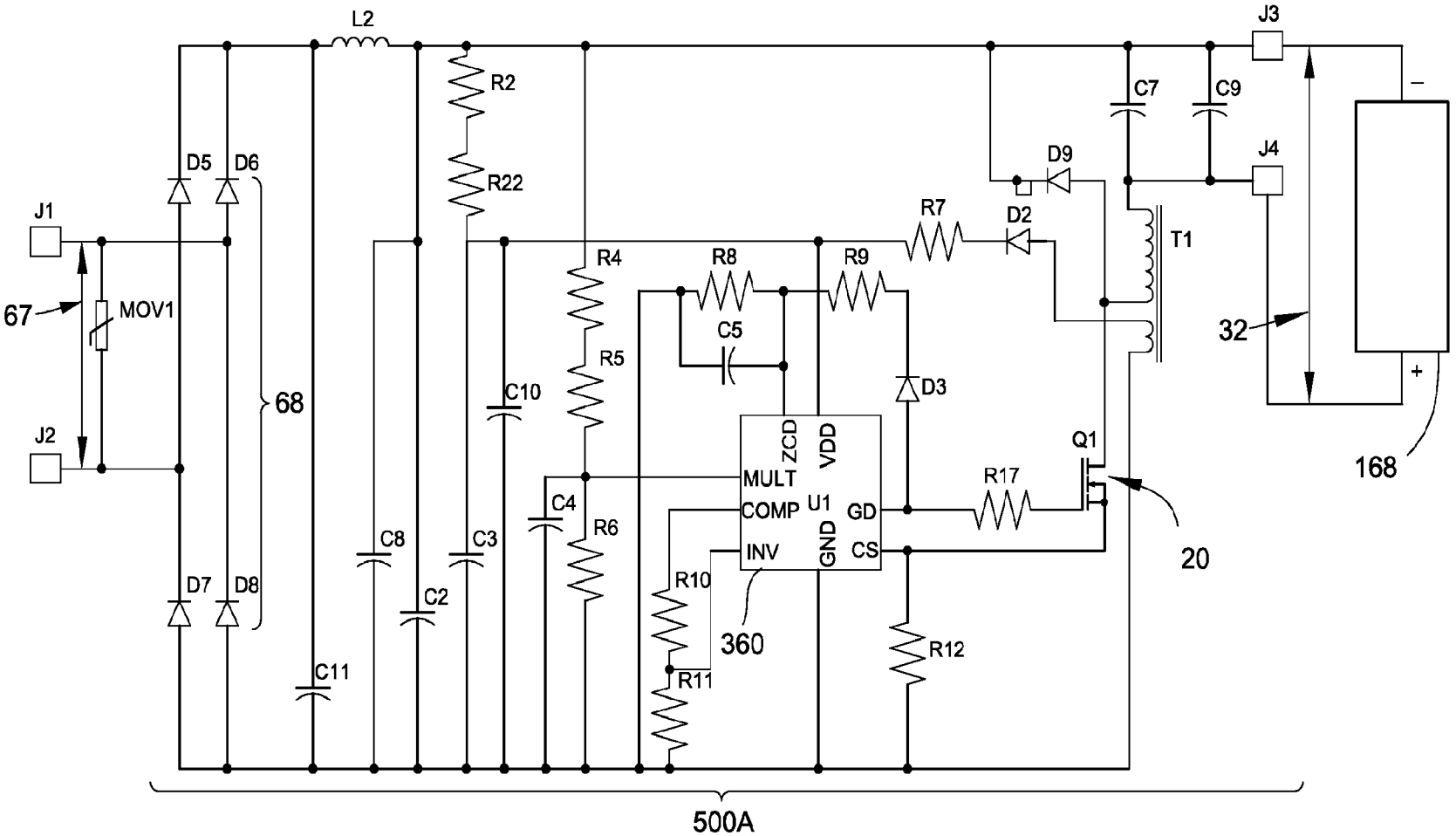

FIG. 12 is a schematic circuit diagram illustrating an example of a high power factor single switching stage power supply 500A. The power supply 500A is similar in several respects to that shown in FIG. 11; however, rather than employing a transformer in a flyback converter configuration, the power supply of FIG. 12 employs a buck converter topology. This allows a significant reduction in losses when the power supply is configured such that the output voltage is a fraction of the input voltage. The circuit of FIG. 12, like the flyback design employed in FIG. 11, achieves a high power factor. In one exemplary implementation, the power supply 500A is configured to accept an input voltage 67 of 120 VAC and provide an output voltage 32 in the range of approximately 30 to 70 VDC. This range of output voltages mitigates against increasing losses at lower output voltages (resulting in lower efficiency), as well as line current distortion (measured as increases in harmonics or decreases in power factor) at higher output voltages.

The circuit of FIG. 12 utilizes the same design principles which result in the apparatus exhibiting a fairly constant input resistance as the input voltage 67 is varied. The condition of constant input resistance may be compromised, however, if either 1) the AC input voltage is less than the output voltage, or 2) the buck converter is not operated in the continuous mode of operation. Harmonic distortion is caused by 1) and is unavoidable. Its effects can only be reduced by changing the output voltage allowed by the load. This sets a practical upper bound on the output voltage. Depending on the maximum allowed harmonic content, this voltage seems to allow about 40% of the expected peak input voltage. Harmonic distortion is also caused by 2), but its effect is less important because the inductor (in transformer T1) can be sized to put the transition between continuous/discontinuous mode close to the voltage imposed by 1). In another aspect, the circuit of FIG. 12 uses a high speed Silicon Carbide Schottky diode (diode D9) in the buck converter configuration. The diode D9 allows the fixed-off time control method to be used with the buck converter configuration. This feature also limits the lower voltage performance of the power supply. As output voltage is reduced, a larger efficiency loss is imposed by the diode D9. For appreciably lower output voltages, the flyback topology used in FIG. 11 may be preferable in some instances, as the flyback topology allows more time and a lower reverse voltage at the output diode to achieve reverse recovery, and allows the use of higher speed, but lower voltage diodes, as well as silicon Schottky diodes as the voltages are reduced. Nonetheless, the use of a high speed Silicon Carbide Schottky diode in the circuit of FIG. 12 allows FOT control while maintaining a sufficiently high efficiency at relatively low output power levels.

Figure 13:
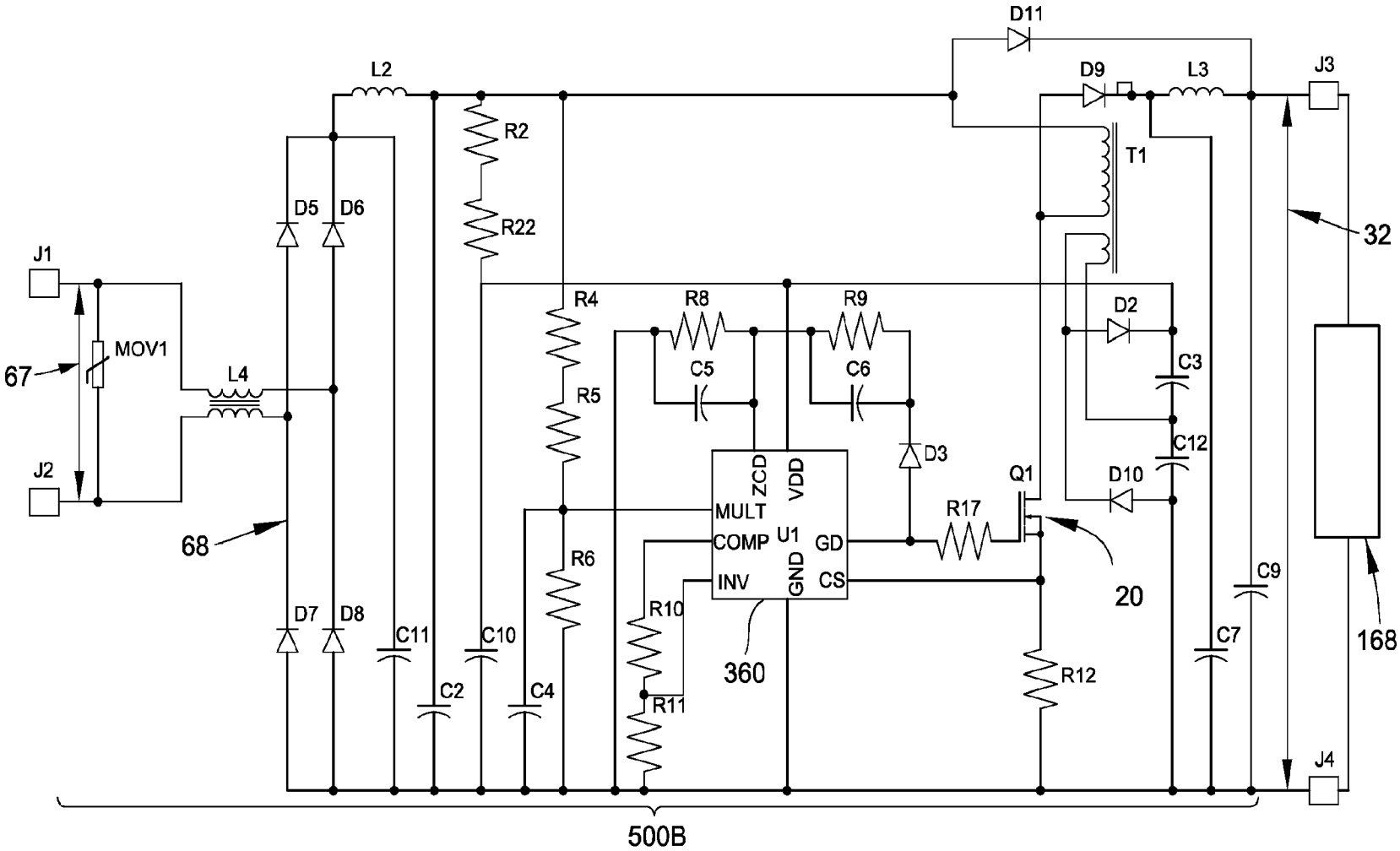

FIG. 13 is a schematic circuit diagram illustrating an example of a high power factor single switching stage power supply 500B according to another embodiment. In the circuit of FIG. 13, a boost converter topology is employed for the power supply 500B. This design also utilizes the fixed off time (FOT) control method, and employs a Silicon Carbide Schottky diode to achieve a sufficiently high efficiency. The range for the output voltage 32 is from slightly above the expected peak of the A.C. input voltage, to approximately three times this voltage. The particular circuit component values illustrated in FIG. 13 provide an output voltage 32 on the order of approximately 300 VDC. In some implementations of the power supply 500B, the power supply is configured such that the output voltage is nominally between 1.4 and 2 times the peak A.C. input voltage. The lower limit (1.4×) is primarily an issue of reliability; since it is worthwhile to avoid input voltage transient protection circuitry due to its cost, a fair amount of voltage margin may be preferred before current is forced to flow through the load. At the higher end (2×), it may be preferable in some instances to limit the maximum output voltage, since both switching and conduction losses increase as the square of the output voltage. Thus, higher efficiency can be obtained if this output voltage is chosen at some modest level above the input voltage.

Figure 14:
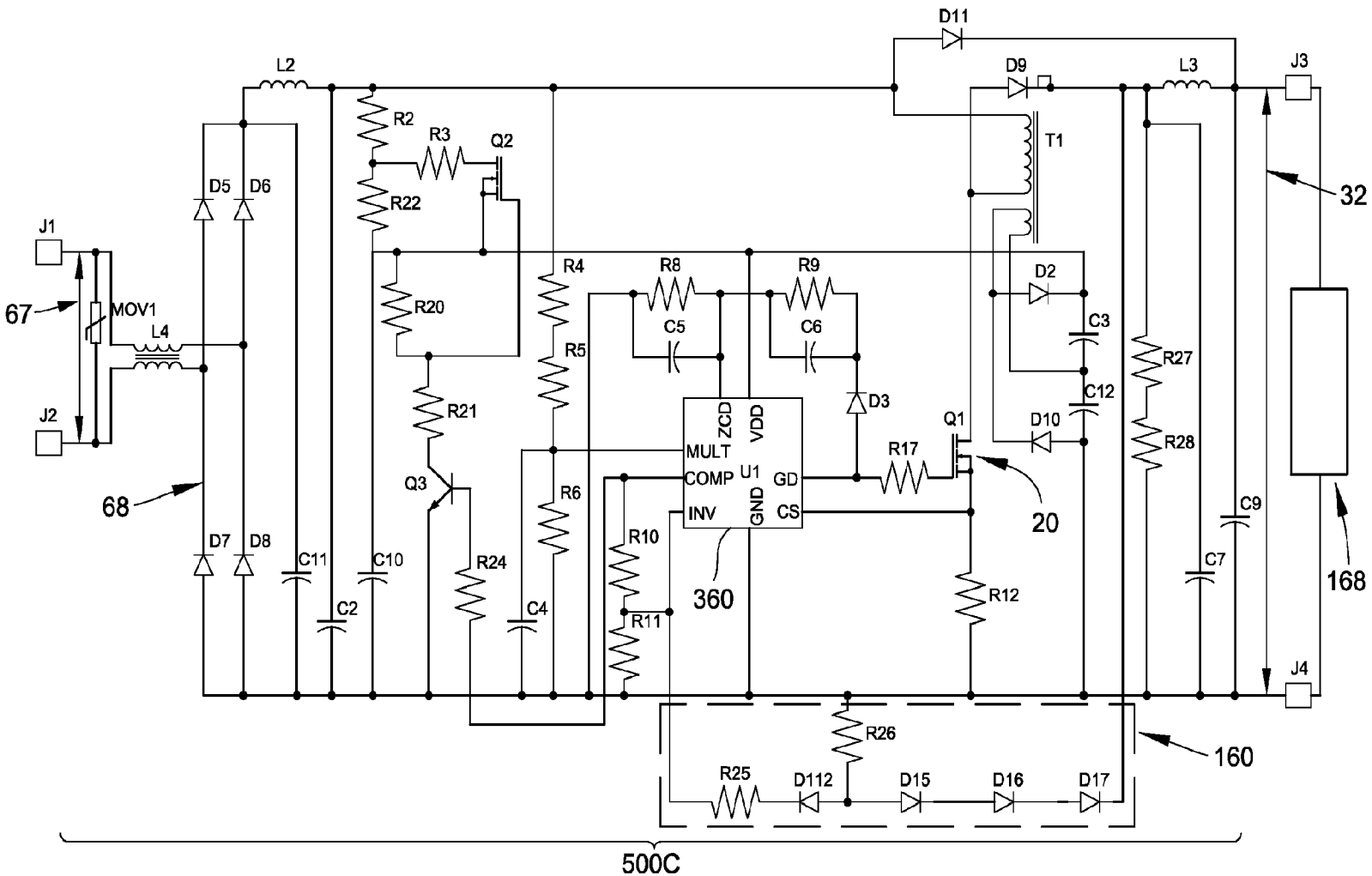

FIG. 14 is a schematic diagram of a power supply 500C according to another embodiment, based on the boost converter topology discussed above in connection with FIG. 13. Because of the potentially high output voltages provided by the boost converter topology, in the embodiment of FIG. 14, an over-voltage protection circuit 160 is employed to ensure that the power supply 500C ceases operation if the output voltage 32 exceeds a predetermined value. In one exemplary implementation, the over-voltage protection circuit includes three series-connected zener diodes D15, D16 and D17 that conduct current if the output voltage 32 exceeds approximately 350 Volts.

More generally, the over-voltage protection circuit 160 is configured to operate only in situations in which the load ceases conducting current from the power supply 500C, i.e., if the load is not connected or malfunctions and ceases normal operation. The over-voltage protection circuit 160 is ultimately coupled to the INV input of the controller 360 so as to shut down operation of the controller 360 (and hence the power supply 500C) if an over-voltage condition exists. In these respects, it should be appreciated that the over-voltage protection circuit 160 does not provide feedback associated with the load to the controller 360 so as to facilitate regulation of the output voltage 32 during normal operation of the apparatus; rather, the over-voltage protection circuit 160 functions only to shut down/prohibit operation of the power supply 500C if a load is not present, disconnected, or otherwise fails to conduct current from the power supply (i.e., to cease normal operation of the apparatus entirely).

As indicated in Table 2 below, the power supply 500C of FIG. 14 may be configured for a variety of different input voltages, based on an appropriate selection of various circuit components.

TABLE 2

| A.C. Input Voltage | R4 | R5 | R10 | R11 |
|---|---|---|---|---|
| 120 V | 750K | 750K | 10K 1% | 20.0K 1% |
| 220 V | 1.5M | 1.5M | 2.49K 1% | 18.2K 1% |
| 100 V | 750K | 750K | 2.49K 1% | 10.0K 1% |
| 120 V | 750K | 750K | 3.90K 1% | 20.0K 1% |
| 220 V | 1.5M | 1.5M | 2.49K 1% | 18.2K 1% |
| 100 V | 750K | 750K | 2.49K 1% | 10.0K 1% |

Figure 15:
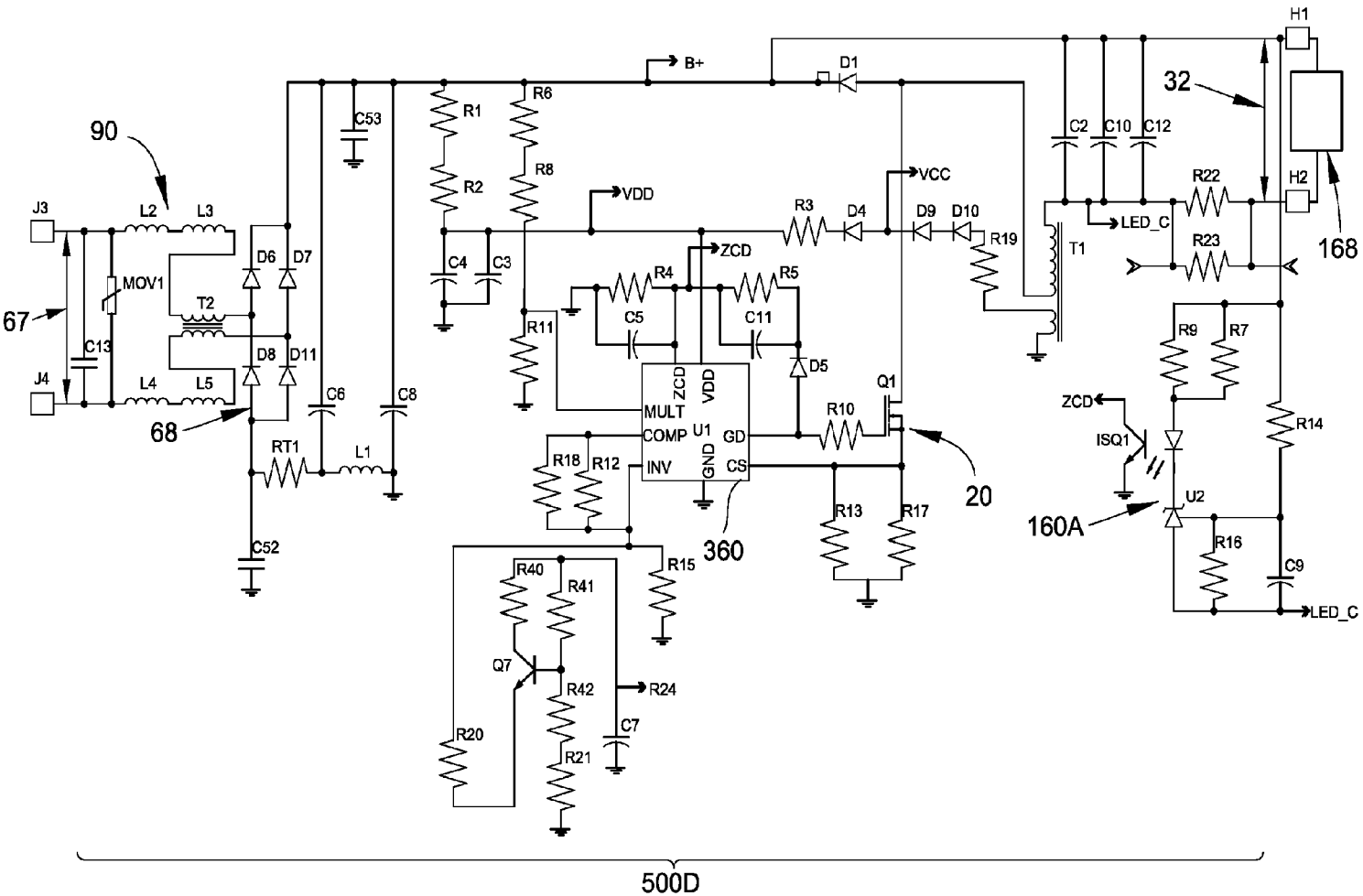

FIG. 15 is a schematic diagram of a power supply 500D based on the buck converter topology discussed above in connection with FIG. 12, but with some additional features relating to over-voltage protection and reducing electromagnetic radiation emitted by the power supply. These emissions can occur both by radiation into the atmosphere and by conduction into wires carrying the A.C. input voltage 67.

In some exemplary implementations, the power supply 500D is configured to meet Class B standards for electromagnetic emissions set in the United States by the Federal Communications Commission and/or to meet standards set in the European Community for electromagnetic emissions from lighting fixtures, as set forth in the British Standards document entitled "Limits and Methods of Measurement of Radio Disturbance Characteristics of Electrical Lighting and Similar Equipment," EN 55015:2001, Incorporating Amendments Nos. 1, 2 and Corrigendum No. 1, the entire contents of which are hereby incorporated by reference. For example, in one implementation, the power supply 500D includes an electromagnetic emissions ("EMI") filter circuit 90 having various components coupled to the bridge rectifier 68. In one aspect, the EMI filter circuit is configured to fit within a very limited space in a cost-effective manner; it is also compatible with conventional A.C. dimmers, so that the overall capacitance is at a low enough level to avoid flickering of light generated by LED light sources 168. The values for the components of the EMI filter circuit 90 in one exemplary implementation are given in the table below:

| Component | Characteristics |
|---|---|
| C13 | 0.15 μF; 250/275 VAC |
| C52, C53 | 2200 pF; 250 VAC |
| C6, C8 | 0.12 nF; 630 V |
| L1 | Magnetic inductor; 1 mH; 0.20 A |
| L2, L3, L4, L5 | Magnetic ferrite inductor; 200 mA; 2700 ohm; 100 MHz; SM 0805 |
| T2 | Magnetic, choke transformer; common mode; 16.5 MH PC MNT |

As further illustrated in FIG. 15 (as indicated at power supply connection "H3" to a local ground "F"), in another aspect the power supply 500D includes a shield connection, which also reduces the frequency noise of the power supply. In particular, in addition to the two electrical connections between the positive and negative potentials of the output voltage 32 and the load, a third connection is provided between the power supply and the load. For example, in one implementation, the LED PCB 164 (see FIG. 2) may include several conductive layers that are electrically isolated from one another. One of these layers, which includes the LED light sources, may be the top-most layer and receive the cathodic connection (to the negative potential of the output voltage). Another of these layers may lie beneath the LED layer and receives the anodic connection (to the positive potential of the output voltage). A third "shield" layer may lie beneath the anodic layer and may be connected to the shield connector. During the operation of the lighting apparatus, the shield layer functions to reduce/eliminate capacitive coupling to the LED layer and thereby suppresses frequency noise. In yet another aspect of the apparatus shown in FIG. 15, and as indicated on the circuit diagram at the ground connection to C52, the EMI filter circuit 90 has a connection to a safety ground, which may provided via a conductive finger clip to a housing of the apparatus (rather than by a wire connected by screws), which allows for a more compact, easy to assemble configuration than conventional wire ground connections.

In yet other aspects shown in FIG. 15, the power supply 500D includes various circuitry to protect against an over-voltage condition for the output voltage 32. In particular, in one exemplary implementation output capacitors C2 and C10 may be specified for a maximum voltage rating of approximately 60 Volts (e.g., 63 Volts), based on an expected range of output voltages of approximately 50 Volts or lower. As discussed above in connection with FIG. 14, in the absence of any load on the power supply, or malfunction of a load leading to no current being drawn from the power supply, the output voltage 32 would rise and exceed the voltage rating of the output capacitors, leading to possible destruction. To mitigate this situation, the power supply 500D includes an over-voltage protection circuit 160A, including an optoisolator ISO1 having an output that, when activated, couples the ZCD (zero current detect) input of the controller 360 (i.e., pin 5 of U1) to local ground "F". Various component values of the over-voltage protection circuit 160A are selected such that a ground present on the ZCD input terminates operation of the controller 360 when the output voltage 32 reaches about 50 Volts. As also discussed above in connection with FIG. 14, again it should be appreciated that the over-voltage protection circuit 160A does not provide feedback associated with the load to the controller 360 so as to facilitate regulation of the output voltage 32 during normal operation of the apparatus; rather, the over-voltage protection circuit 160A functions only to shut down/prohibit operation of the power supply 500D if a load is not present, disconnected, or otherwise fails to conduct current from the power supply (i.e., to cease normal operation of the apparatus entirely).

FIG. 15 also shows that the current path to the load (LED light sources 168) includes current sensing resistors R22 and R23, coupled to test points TPOINT1 and TPOINT2. These test points are not used to provide any feedback to the controller 360 or any other component of the power supply 500D. Rather, the test points TPOINT1 and TPOINT2 provide access points for a test technician to measure load current during the manufacturing and assembly process and, with measurements of load voltage, determine whether or not the load power falls within a prescribed manufacturer's specification for the apparatus.

As indicated in Table 3 below, the power supply 500D of FIG. 15 may be configured for a variety of different input voltages, based on an appropriate selection of various circuit components.

TABLE 3

| A.C. Input Voltage | R6 | R8 | R1 | R2 | R4 | R18 | R17 | R10 | C13 |
|---|---|---|---|---|---|---|---|---|---|
| 100 V | 750K 1% | 750K 1% | 150K | 150K | 24.0K 1% | 21.0K 1% | 2.00 1% | 22 | 0.15 μF |
| 120 V | 750K 1% | 750K 1% | 150K | 150K | 24.0K 1% | 12.4K 1% | 2.00 1% | 22 | 0.15 μF |
| 230 V | 1.5M 1% | 1.5M 1% | 300K | 300K | 27.0K 1% | 24.0K 1% | OMIT | 10 | 0.15 μF |
| 277 V | 1.5M 1% | 1.5M 1% | 300K | 300K | 27.0K 1% | 10K 1% | OMIT | 10 | OMIT |

Thus, a lighting apparatus in accordance with the present disclosure provides numerous advantages over the prior art. An integrated secondary optical facility is compressively coupled to a pressure-transfer member and sealably disposed on a heat sink, so as to seal and secure an LED PCB to the heat sink, thereby reducing the number of components, reducing the need for adhesives, and providing an environmentally-friendly lighting apparatus that is easily disassembled for repair or replacement of individual parts. The lighting apparatus of the disclosure further provides excellent dissipation of heat from the LED PCB, thereby preventing overheating and extending the operating lifetime of the lighting apparatus.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

The invention claimed is:

1. A lighting apparatus, comprising:

a heat sink having a first surface;

an LED printed circuit board having second and third opposing surfaces, wherein the second surface is disposed on the first surface of the heat sink and wherein the third surface has at least one LED light source disposed thereon;

an integrated lens-housing member having a transparent upper wall disposed to receive light emitted by the at least one LED light source;

a pressure-transfer member having a support structure extending generally in the direction from the LED printed circuit board to the transparent upper wall of the integrated lens-housing member and defining an aperture, a compliant member interposed between the integrated lens-housing member and the support structure of the pressure-transfer member, and a pressure-transfer surface connected to the support structure and disposed on the third surface of said LED printed circuit board proximate to the LED light source; and an optic member disposed in the aperture defined by the support structure of the pressure-transfer member, wherein the integrated lens-housing member is compressively coupled to the pressure-transfer member, such that a force exerted by the integrated lens-housing member is transferred via the pressure-transfer member to the pressure-transfer surface so as to press the LED printed circuit board toward the first surface of the heat sink to facilitate heat transfer from the LED printed circuit board to the heat sink wherein the compliant member is selected to include a compression recovery and is disposed on a top rim of the pressure-transfer member and extends generally in a direction of the transparent upper wall to provide a fourth surface to engage the transparent upper wall when the integrated lens-housing member is compressively coupled to the pressure-transfer member, and wherein the integrated lens-housing member is not compressively coupled to the optic member.

2. The lighting apparatus of claim 1, wherein the integrated lens-housing member has opposing side walls contiguous with the transparent upper wall, and wherein the opposing side walls are connected to the heat sink so as to generate the force exerted by the integrated lens-housing member onto the pressure-transfer member.

3. The lighting apparatus of claim 2, wherein the integrated lens-housing member further comprises a first over-molded end wall and a second over-molded end wall each contiguous with the opposing side walls and the transparent upper wall, and wherein the first over-molded end wall and the second over-molded end wall oppose each other.

4. The lighting apparatus of claim 3, further comprising a first lighting apparatus and a second lighting apparatus arranged linearly relative to each other, wherein the first lighting apparatus includes a third over-molded end wall, wherein the second lighting apparatus includes a fourth over-molded end wall, and wherein the third over-molded end wall abuts the fourth over-molded end wall.

5. The lighting apparatus of claim 4, wherein a distance between the third over-molded end wall and the fourth over-molded end wall is less than about 3 millimeters, thereby defining a gap between the first lighting apparatus and the second lighting apparatus.

6. The lighting apparatus of claim 1, wherein the integrated lens-housing member is connected to the heat sink by a non-adhesive connector, and the transparent upper wall of the integrated lens-housing member has an inner surface having at least one connecting pin.

7. The lighting apparatus of claim 6, further comprising a light diffusion layer disposed on the inner surface of the transparent upper wall, the connecting pin being configured to hold the light diffusion layer against the inner surface of the transparent upper wall.

8. The lighting apparatus of claim 1, wherein the compliant member comprises a thermoplastic elastomer.

9. The lighting apparatus of claim 1, further comprising a thermal interface layer interposed between the LED printed circuit board and the first surface of the heat sink.

10. The lighting apparatus of claim 9, wherein the thermal interface layer comprises graphite.

11. The lighting apparatus of claim 1, wherein the integrated lens-housing member further has opposing end walls contiguous with the transparent upper wall.

12. The lighting apparatus of claim 1, wherein the integrated lens-housing member comprises a polycarbonate.

13. The lighting apparatus of claim 1, wherein a shortest distance between the pressure-transfer surface and the LED light source is less than about 2 millimeters, and a minimum thickness of the integrated lens-housing member is about 3 millimeters.

14. The lighting apparatus of claim 1, wherein the pressure-transfer member is opaque.

15. The lighting apparatus of claim 1, wherein the optic member comprises a total internal reflection optic.

* * * * *